US008750765B2

(12) United States Patent
Watanabe et al.

(10) Patent No.: US 8,750,765 B2
(45) Date of Patent: Jun. 10, 2014

(54) DEVELOPING DEVICE AND IMAGE FORMING APPARATUS PROVIDED THEREWITH

(75) Inventors: Akihiro Watanabe, Osaka (JP); Hiroyuki Hamakawa, Osaka (JP); Hiroshi Yamazaki, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 209 days.

(21) Appl. No.: 12/967,336

(22) Filed: Dec. 14, 2010

(65) Prior Publication Data

US 2011/0150537 A1 Jun. 23, 2011

(30) Foreign Application Priority Data

Dec. 21, 2009 (JP) ..... 2009-289190
Dec. 21, 2009 (JP) ..... 2009-289220
Feb. 24, 2010 (JP) ..... 2010-039099

(51) Int. Cl.
*G03G 15/08* (2006.01)

(52) U.S. Cl.
CPC ..... *G03G 15/0839* (2013.01)
USPC ..... 399/256; 399/257; 399/260

(58) Field of Classification Search
CPC ..... G03G 15/0839
USPC ..... 399/256, 257, 260
See application file for complete search history.

(56) References Cited

U.S. PATENT DOCUMENTS 5,963,766 A * 10/1999 Okuno et al. ..... 399/256
6,587,661 B1 * 7/2003 Shimmura et al. ..... 399/257
7,305,206 B2 * 12/2007 Hart et al. ..... 399/256
7,835,672 B2 * 11/2010 Sakamoto et al. ..... 399/254
2006/0245792 A1 * 11/2006 Tatsumi et al. ..... 399/254
2009/0060534 A1 * 3/2009 Murauchi et al. ..... 399/30
2009/0103952 A1 * 4/2009 Sakamoto et al. ..... 399/258
2009/0214266 A1 * 8/2009 Kato et al. ..... 399/254
2009/0290886 A1 * 11/2009 Murauchi et al. ..... 399/27
2012/0177412 A1 * 7/2012 Watanabe et al. ..... 399/256

FOREIGN PATENT DOCUMENTS

JP 10142927 A * 5/1998 ..... G03G 15/08
JP 2001-265098 9/2001
JP 2003195638 A * 7/2003 ..... G03G 15/08
JP 2003-195638 9/2003
JP 2005-221852 8/2005
JP 2005221852 A * 8/2005 ..... G03G 15/08
JP 2005-266511 9/2005
JP 2005266511 A * 9/2005 ..... G03G 15/08
JP 2006-323238 11/2006
JP 2006323238 A * 11/2006
JP 2009-237043 10/2009

* cited by examiner

*Primary Examiner* — David Gray
*Assistant Examiner* — Tyler Hardman
(74) *Attorney, Agent, or Firm* — Smith, Gambrell & Russell LLP

(57) ABSTRACT

Provided is a developing device including: a developing container including a developer replenishing port from which the developer is replenished, and a developer discharge port which is provided on a downstream side of one of the conveyance paths and from which surplus developer is discharged; and a discharge regulating portion provided to one of the plurality of stirring members which is arranged in the one of the conveyance paths, in which the discharge regulating portion includes a regulating member arranged so as to face the developer discharge port, for regulating movement of the developer to the developer discharge port side, and a decelerating conveyance member arranged between the helical blade and the regulating member, for partially reducing a conveying speed of the developer in the one of the conveyance paths.

3 Claims, 19 Drawing Sheets

DEVELOPING DEVICE AND IMAGE FORMING APPARATUS PROVIDED THEREWITH

This application is based upon and claims the benefit of priority from the corresponding Japanese Patent Application No. 2009-289220 filed on Dec. 21, 2009, Japanese Patent Application No. 2009-289190 filed on Dec. 21, 2009, and Japanese Patent Application No. 2010-039099 filed on Feb. 24, 2010, the entire contents of which are incorporated herein by reference.

BACKGROUND OF THE INVENTION

1. Field of the Invention

The present invention relates to a developing device used in an image forming apparatus such as an electrophotographic copier, a printer, a facsimile, and a composite apparatus having functions of those devices, and to an image forming apparatus provided with the developing device. In particular, the present invention relates to a developing device which replenishes a two-component developer including toner and carrier and discharges surplus developer and to an image forming apparatus provided with the developing device.

2. Description of Related Art

In image forming apparatuses, an electrostatic latent image formed on an image carrier including a photosensitive member and the like is developed by a developing device and visualized as a toner image. Examples of the developing device include one employing a two-component developing method in which a two-component developer is used. The developing device of this type includes a developing container in which a two-component developer including toner and carrier is stored, and there are arranged a developing roller for supplying the developer to the image carrier and a stirring member for supplying the developer in the developing container to the developing roller while stirring and conveying the developer.

In the developing device, the toner is consumed by a developing operation; meanwhile, the carrier remains in the developing device without being consumed. Accordingly, the carrier stirred together with the toner in the developing container is deteriorated in proportion to a stirring frequency. As a result, charging performance of the carrier with respect to the toner is gradually deteriorated.

In this context, there has been well-known a developing device according to a first related art in which deterioration of charging performance is suppressed by replenishment of developer including carrier into a developing container and discharge of surplus developer.

In the developing device according to the first related art, two stirring members each including a rotary shaft and a helical blade helically formed about an outer periphery of the rotary shaft are arranged in parallel with each other in respective conveyance paths. A partition portion is provided between the conveyance paths, and communication portions for exchanging developer are provided to both end portions of the partition portion. A developer discharge port is provided on a downstream side of the conveyance path with respect to a developer conveying direction. Between the stirring member and the developer discharge port, a reverse helical blade helically formed in a direction reverse to that of the helical blade of each of the stirring members is provided as a discharge regulating portion integrally with the rotary shaft. With this structure, when being replenished into the developing container, developer is conveyed to the downstream side of the conveyance path while being stirred by rotation of the stirring members. When being rotated in the same direction as that of the stirring members, the reverse helical blade imparts a conveyance force in a direction reverse to the developer conveying direction due to the stirring members to the developer. The developer is retained by the conveyance force in the reverse direction on the downstream side of the conveyance path and increased in height. As a result, surplus developer climbs over the reverse helical blade (discharge regulating portion) so as to move to the developer discharge port, with the result of being discharged outside.

However, in the developing device according to the first related art, even when new developer is not replenished, the developer conveyed by the helical blade of each of the stirring members moves to the downstream side of the conveyance path in an undulating manner in conformity with an outer periphery of the helical blade, with the result of colliding against the discharge regulating portion. When the developer collides against the discharge regulating portion, a height of the developer with respect to an outer periphery of the discharge regulating portion varies from each other in accordance with axial positions of the helical blade with respect to the discharge regulating portion. When the developer collides against the discharge regulating portion at a position at which the developer has height, the developer climbs over the discharge regulating portion so as to move into the developer discharge port by an impact of the collision. As a result, the developer is excessively discharged, which may lead to a risk of instability of the developer amount in the developing container. In particular, in an apparatus performing high-speed image formation, the stirring members are rotated at high speed together with the photosensitive member, and hence there prominently occurs an inconvenience of excessive discharge of the developer.

SUMMARY OF THE INVENTION

It is therefore an object of the present invention to provide a developing device and an image forming apparatus provided therewith, the developing device having a simple structure with which surplus developer is stably discharged from a developing container and a developer amount in the developing container is accurately maintained to a desired amount.

A developing device according to one aspect of the present invention, includes: a developing roller for supplying developer to an image carrier; a plurality of stirring members each including a helical blade helically extending about a rotary shaft in an axial direction of the rotary shaft, for stirring and conveying the developer supplied to the developing roller; a developing container including a partition portion for partitioning the developing container into conveyance paths in which the developer is circulatingly conveyed by the plurality of stirring members, communication portions for communicating the conveyance paths with each other on both-end-portion sides in a long side direction of the partition portion, a developer replenishing port from which the developer is replenished, and a developer discharge port which is provided on a downstream side of one of the conveyance paths and from which surplus developer is discharged; and a discharge regulating portion provided to one of the plurality of stirring members which is arranged in the one of the conveyance paths, in which the discharge regulating portion includes a regulating member arranged so as to face the developer discharge port, for regulating movement of the developer to the developer discharge port side, and a decelerating conveyance member arranged between the helical blade and the regulating member, for partially reducing a conveying speed of the developer in the one of the conveyance paths.

Further, a developing device according to another aspect of the present invention, includes: a developing roller for supplying developer to an image carrier; a plurality of stirring members each including a helical blade helically extending about a rotary shaft in an axial direction of the rotary shaft, for stirring and conveying the developer supplied to the developing roller; a developing container including a partition portion for partitioning the developing container into conveyance paths in which the developer is circulatingly conveyed by the plurality of stirring members, communication portions for communicating the conveyance paths with each other on both-end-portion sides in a long side direction of the partition portion, a developer replenishing port from which the developer is replenished, a developer discharge port which is provided on a downstream side of one of the conveyance paths and from which surplus developer is discharged, and a side wall portion formed near the developer discharge port of the one of the conveyance paths; and a discharge regulating portion provided to one of the plurality of stirring members which is arranged in the one of the conveyance paths, in which the discharge regulating portion includes a conveying blade formed between the helical blade and the developer discharge port, for conveying the developer from the one of the conveyance paths to another of the conveyance paths through intermediation of the communication portions, and a plate member provided on the developer discharge port side of the conveying blade, for regulating movement of the developer to the developer discharge port side, the plate member being arranged so that an outer peripheral surface of the plate member forms a gap with respect to the side wall portion and an end surface of the side wall portion is positioned on an axial width of the plate member.

Still further, a developing device according to another aspect of the present invention, includes: a developing roller for supplying developer to an image carrier; a plurality of stirring members each including a helical blade helically extending about a rotary shaft in an axial direction of the rotary shaft, for stirring and conveying the developer supplied to the developing roller; a developing container including a partition portion for partitioning the developing container into conveyance paths in which the developer is circulatingly conveyed by the plurality of stirring members, communication portions for communicating the conveyance paths with each other on both-end-portion sides in a long side direction of the partition portion, a developer replenishing port from which the developer is supplied, and a developer discharge port which is provided on a downstream side of one of the conveyance paths and from which surplus developer is discharged; and a discharge regulating portion provided to one of the plurality of stirring members which is arranged in the one of the conveyance paths, in which the discharge regulating portion includes a reverse helical blade helically formed in a reverse phase with respect to the helical blade of each of the plurality of stirring members, the reverse helical blade being formed to have an outer diameter larger than an outer diameter of the helical blade of each of the plurality of stirring members.

Further features and advantages of the present invention will become apparent from the description of embodiments given below.

DETAILED DESCRIPTION OF PREFERRED EMBODIMENTS

In the following, although embodiments of the present invention are described with reference to drawings, the present invention is not limited to the embodiments. Further, use of the present invention, terms used herein, and the like are not limited to the embodiments as well.

First Embodiment

Figure 1:
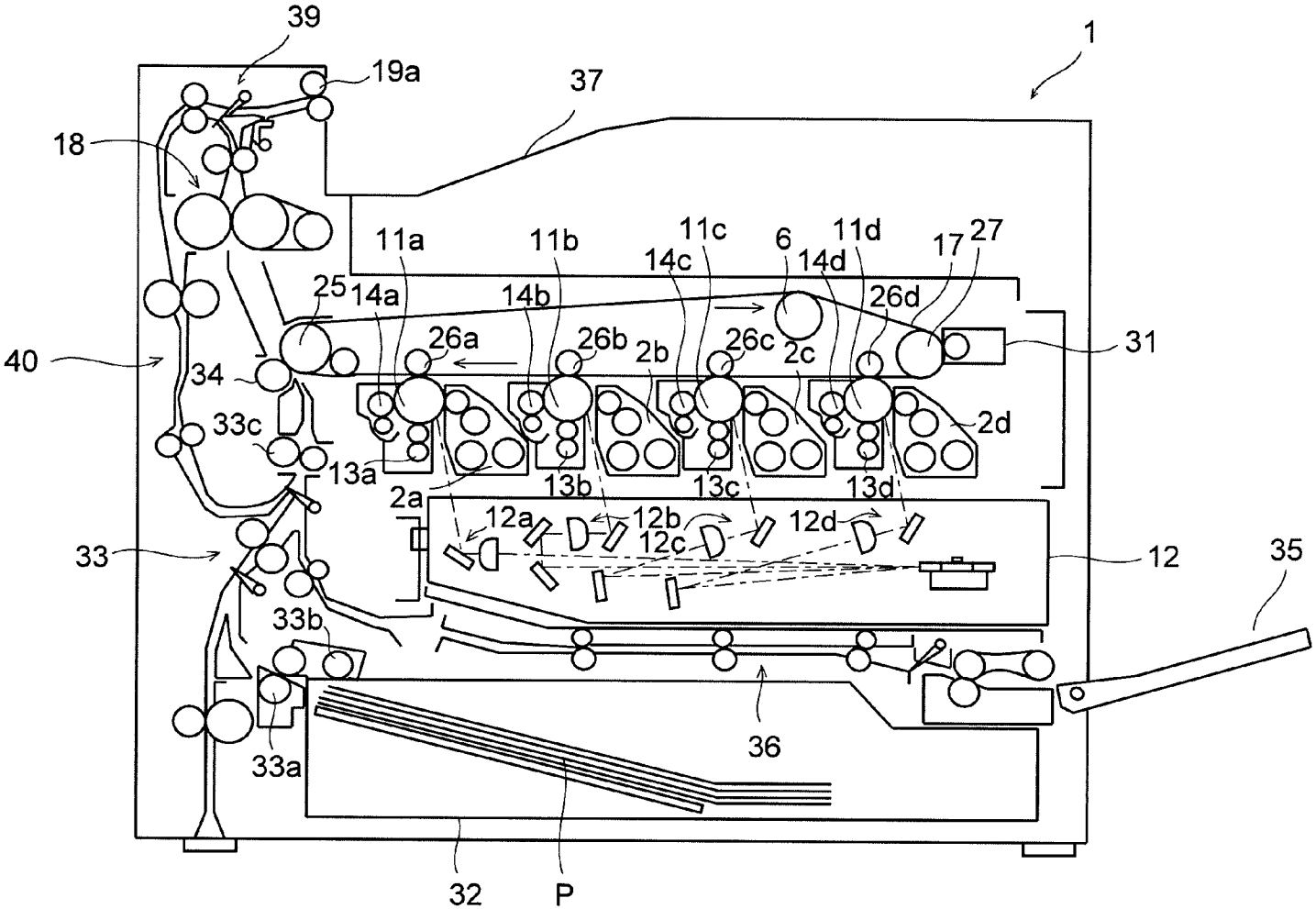
FIG. 1 is a schematic plan view of an entire structure of an image forming apparatus including a developing device according to a first embodiment of the present invention.

FIG. 1 is a schematic plan view of a structure of an image forming apparatus including a developing device according to an embodiment of the present invention. An image forming apparatus 1 is a tandem color printer, and has rotatable photosensitive members 11*a* to 11*d* for each of which an organic photosensitive member (OPC photosensitive member) is used as a photosensitive material forming a photosensitive layer and which are arranged correspondingly to the following respective colors: black, yellow, cyan, and magenta. Around the photosensitive members 11*a* to 11*d*, there are arranged developing devices 2*a* to 2*d*, exposure units 12*a* to 12*d*, charger 13*a* to 13*d*, and cleaning devices 14*a* to 14*d*, respectively.

The developing devices 2*a* to 2*d* are arranged respectively on the right of the photosensitive members 11*a* to 11*d* so as to face each other, and supply toners to the photosensitive members 11*a* to 11*d*. The charger 13*a* to 13*d* are arranged respectively on upstream sides of the developing devices 2*a* to 2*d* with respect to photosensitive-member rotational directions so as to face surfaces of the photosensitive members 11*a* to 11*d*, and uniformly charge the surfaces of the photosensitive members 11*a* to 11*d*.

The exposure unit 12 is provided for effecting scanning exposure on the photosensitive members 11*a* to 11*d* based on image data of characters, patterns, and the like, which have been input from personal computers and the like to an image input portion (not shown). The exposure unit 12 is provided below the developing devices 2*a* to 2*d*. The exposure unit 12 is provided with a laser light source and a polygon mirror, and reflecting mirrors and lenses are provided correspondingly to the photosensitive members 11*a* to 11*d*. A laser beam emitted from the laser light source is applied to each of the surfaces of the photosensitive members 11*a* to 11*d* from downstream sides of photosensitive-member rotational directions of the charger 13*a* to 13*d* through intermediation of the polygon mirror, the reflecting mirrors, and the lenses. The applied laser beam forms an electrostatic latent image on the surface of each of the photosensitive members 11*a* to 11*d*, and the electrostatic latent image is developed by each of the developing devices 2*a* to 2*d* into a toner image.

An endless intermediate transfer belt 17 is stretched around a tension roller 6, a drive roller 25, and a driven roller 27. The drive roller 25 is rotationally driven by a motor (not shown), and the intermediate transfer belt 17 is circulatingly driven by rotation of the drive roller 25.

The photosensitive members 11*a* to 11*d* are arranged adjacently to each other along a conveying direction (arrow direction of FIG. 1) below the intermediate transfer belt 17 so as to come into contact with the intermediate transfer belt 17. Primary transfer rollers 26*a* to 26*d* respectively face the photosensitive members 11*a* to 11*d* with the intermediate transfer belt 17 being sandwiched therebetween, and come into press contact with the intermediate transfer belt 17 so as to form a primary transfer portion thereon. In the primary transfer portion, the toner image on each of the photosensitive members 11*a* to 11*d* is sequentially transferred onto the intermediate transfer belt 17 at a predetermined timing in accordance with rotation of the intermediate transfer belt 17. In this manner, a toner image obtained by superimposition of the toner images of the four colors: cyan, yellow, magenta, and black, is formed on a surface of the intermediate transfer belt 17.

A secondary transfer roller 34 faces the drive roller 25 with the intermediate transfer belt 17 being sandwiched therebetween, and comes into press contact with the intermediate transfer belt 17 so as to form a secondary transfer portion. In the secondary transfer portion, the toner image on the surface of the intermediate transfer belt 17 is transferred onto a sheet P. After the transfer, a belt cleaning device 31 removes residual toner left on the intermediate transfer belt 17.

A sheet-feeding cassette 32 for storing the sheets P is arranged on a lower side of the image forming apparatus 1, and a stack tray 35 for feeding sheets having been manually fed is arranged on the right of the sheet-feeding cassette 32. On the left of the sheet-feeding cassette 32, there is arranged a first sheet-conveyance path 33 for conveying the sheets P sent out from the sheet-feeding cassette 32 to the second transfer portion of the intermediate transfer belt 17. Further, on the left of the stack tray 35, there is arranged a second sheet-conveyance path 36 for conveying the sheets P sent out from the stack tray 35 to the second transfer portion. Further, on the upper left of the image forming apparatus 1, there are arranged a fixing portion 18 for performing fixing treatment with respect to the sheets P on which images are formed, and a third sheet-conveyance path 39 for conveying the sheets P subjected to the fixing treatment to a sheet delivery portion 37.

The sheet-feeding cassette 32 enables sheet replenishment by being drawn outside the apparatus (reader's side of FIG. 1), and the sheets P received therein are sent out one by one to a first sheet-conveyance path 33 side by a pick-up roller 33*b* and a fanning roller 33*a*.

The first sheet-conveyance path 33 and the second sheet-conveyance path 36 merge with each other before a registration roller 33*c*. The registration roller 33*c* times an image forming operation and a sheet-feeding operation on the intermediate transfer belt 17 to each other, and then the sheets P are conveyed to the second transfer portion. Each of the sheets P conveyed to the second transfer portion is subjected to secondary transfer of the toner image on the intermediate transfer belt 17 by the secondary transfer roller 34 applied with a bias potential, and then conveyed to the fixing portion 18.

The fixing portion 18 includes a fixing belt heated by a heater, a fixing roller held in internal contact with the fixing belt, a pressure roller arranged while being held in press contact with the fixing roller with the fixing belt being held therebetween, and the like. The fixing portion 18 performs the fixing treatment by heating and pressurizing the sheets P onto which the toner images are transferred. After the toner image is fixed in the fixing portion 18, each of the sheets P is inverted in a fourth sheet-conveyance path 40 when necessary, and a rear surface of each of the sheets P is also subjected to secondary transfer of a toner image by the secondary transfer roller 34. Then, the toner image is fixed in the fixing portion 18. The sheets P on each of which the toner image is transferred pass through the third sheet-conveyance path 39, and then delivered onto a sheet delivery portion 37 by a delivery roller 19*a*.

Figure 2:
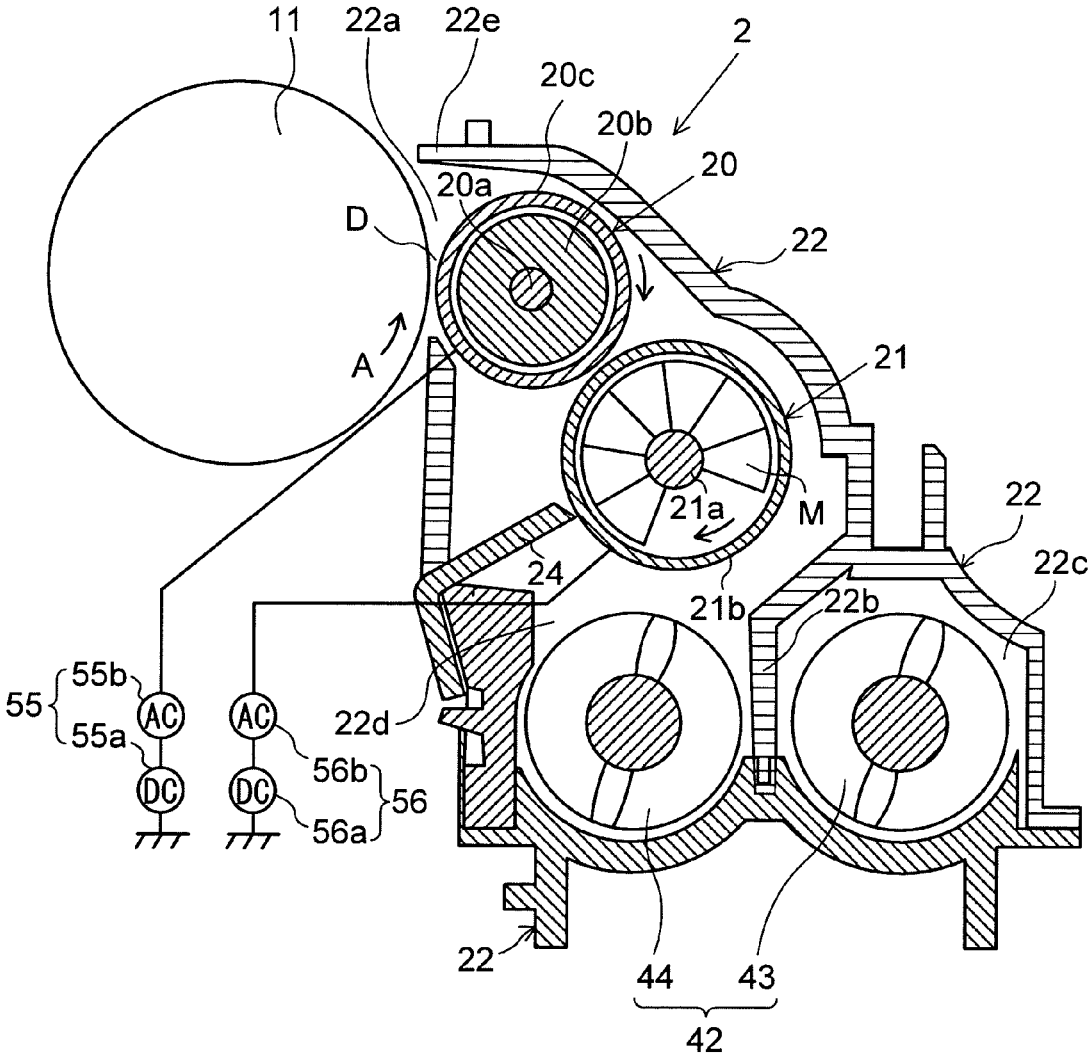
FIG. 2 is a schematic sectional plan view of the developing device according to the first embodiment of the present invention.

FIG. 2 is a sectional plan view of a configuration of the developing device used in the above-mentioned image forming apparatus 1. Note that, although the following description is made only of a configuration and an operation of the developing device 2*a* corresponding to the photosensitive member 11*a* illustrated in FIG. 1, the configurations and operations of the developing devices 2*b* to 2*d* are the same as those of the developing device 2*a*. Thus, description thereof and reference symbols a to d indicating the developing devices and the photosensitive members of the respective four colors are omitted.

As illustrated in FIG. 2, the developing device 2 includes a developing roller 20, a magnetic roller 21, a regulating blade 24, a stirring member 42, and a developing container 22.

The developing container 22 constitutes an outer casing of the developing device 2, and includes a lower portion partitioned into a first conveyance path 22*c* and a second conveyance path 22*d* by a partition portion 22*b*. A developer including carrier and toner is stored in the first conveyance path 22*c* and the second conveyance path 22*d*. Further, the developing container 22 rotatably holds the stirring member 42, the magnetic roller 21, and the developing roller 20. Still further, the developing container 22 is provided with an opening 22*a* for exposing the developing roller 20 to the photosensitive member 11.

The developing roller 20 faces the photosensitive member 11, and is arranged on the right of the photosensitive member 11 at a certain interval. Further, the developing roller 20 forms, at a facing position near the photosensitive member 11, a developing region D in which toner is supplied to the photosensitive member 11. The magnetic roller 21 faces the developing roller 20 at a certain interval, and is arranged on the diagonally lower right of the developing roller 20. Further, the magnetic roller 21 supplies toner to the developing roller 20 at the facing position near the developing roller 20. The stirring member 42 is arranged substantially below the magnetic roller 21. Further, the regulating blade 24 is fixedly held by the developing container 22 on the diagonally lower left of the magnetic roller 21.

The stirring member 42 includes two members: a first stirring member 43; and a second stirring member 44. Below the magnetic roller 21, the second stirring member 44 is provided in the second conveyance path 22*d*. On the right of the second stirring member 44, the first stirring member 43 is provided adjacently thereto in the first conveyance path 22*c*.

The first stirring member 43 and the second stirring member 44 stir developer so that toner in the developer is charged to a predetermined level. In this manner, the toner is held by carrier. Communication portions (not shown) are provided at both end parts in a long side direction (direction between the reader's side and the side opposite to the reader's side of FIG. 2) of the partition portion 22*b* for partitioning the developing container 22 into the first conveyance path 22*c* and the second conveyance path 22*d*. When the first stirring member 43 is rotated, the charged developer is conveyed through one of the communication portions provided to the partition portion 22*b* to the second stirring member 44, and circulates inside the first conveyance path 22*c* and the second conveyance path 22*d*. Then, the developer is supplied from the second stirring member 44 to the magnetic roller 21.

The magnetic roller 21 includes a roller shaft 21*a*, a magnetic-pole member M, and a rotary sleeve 21*b* made of a non-magnetic material. The magnetic roller 21 holds the developer supplied from the stirring member 42 and supplies only toner of the held developer to the developing roller 20. The magnetic-pole member M has outer peripheral portions each of which is formed to have a sector shape in cross section and on which a plurality of magnets having different polarities are arranged. The magnetic-pole member M is firmly attached to the roller shaft 21*a* by bonding or the like. The roller shaft 21*a* is non-rotatably supported by the developing container 22 with a predetermined interval provided between the magnetic-pole member M and the rotary sleeve 21*b*. The rotary sleeve 21*b* is rotated in the same direction as that of the developing roller 20 (clockwise direction in FIG. 2) by a driving mechanism including a motor and gears (not shown), and is applied with a bias 56 obtained by superimposition of an alternating voltage 56*b* onto a direct voltage 56*a*. On a surface of the rotary sleeve 21*b*, the charged developer is held with a magnetic brush being formed by a magnetic force of the magnetic-pole member M, and the magnetic brush is adjusted to have a predetermined height by the regulating blade 24.

When the rotary sleeve 21*b* is rotated, the magnetic brush is conveyed while being held on the surface of the rotary sleeve 21*b* by the magnetic-pole member M. When the magnetic brush comes into contact with the developing roller 20, only toner of the magnetic brush is supplied to the developing roller 20 in accordance with the bias 56 applied to the rotary sleeve 21*b*.

The developing roller 20 includes a fixing shaft 20*a*, a magnetic-pole member 20*b*, and a developing sleeve 20*c* made of a non-magnetic metal material into a cylindrical shape.

The fixing shaft 20*a* is non-rotatably supported by the developing container 22. The developing sleeve 20*c* is rotatably held by the fixing shaft 20*a*, and the magnetic-pole member 20*b* formed of a magnet is firmly attached by bonding or the like to a position of facing the magnetic roller 21 at a certain interval with respect to the developing sleeve 20*c*. The developing sleeve 20*c* is rotated in an arrow direction by a driving mechanism including a motor and gears (not shown). Further, the developing sleeve 20*c* is applied with a developing bias 55 obtained by superimposition of an alternating voltage 55*b* onto a direct voltage 55*a*.

When the developing sleeve 20*c* applied with the developing bias 55 is rotated in the arrow direction, in the developing region D, a potential difference between a developing bias potential and a potential of an exposed part of the photosensitive member 11 causes the toner held on a surface of the developing sleeve 20*c* to fly to the photosensitive member 11. Particles of the toner having flown sequentially adhere to the exposed part on the photosensitive member 11 rotated in an arrow A direction, and the electrostatic latent image on the photosensitive member 11 is developed.

Figure 3:
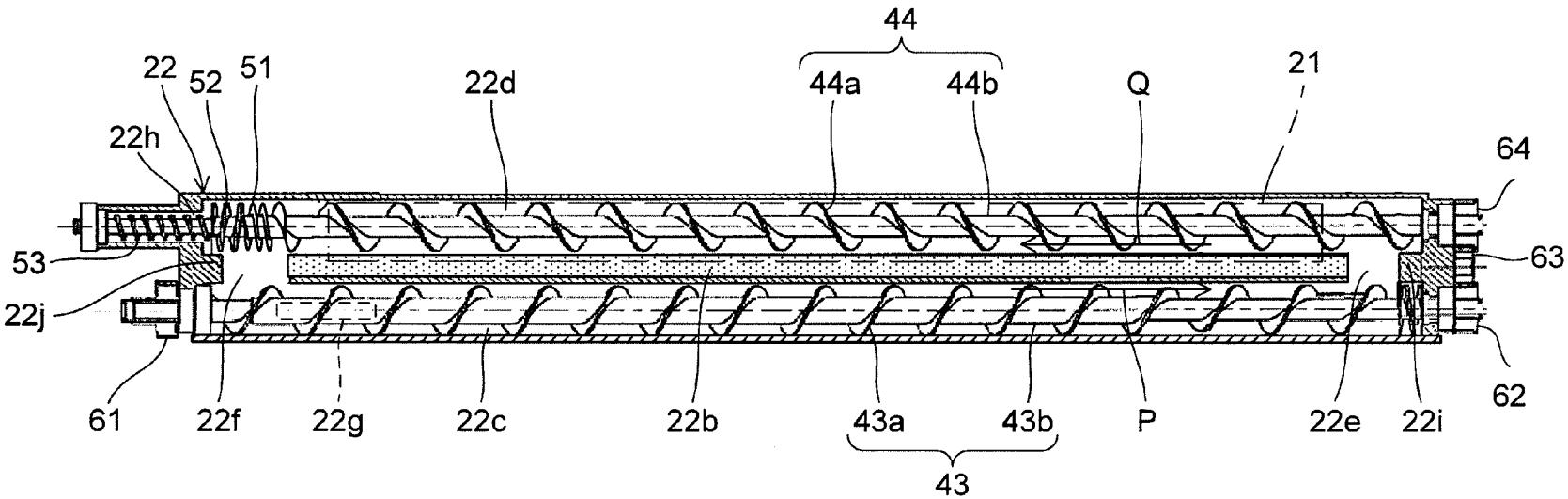
FIG. 3 is a sectional side view of a stirring portion of the developing device according to the first embodiment of the present invention.

Next, detailed description is made of a stirring portion of the developing device with reference to FIG. 3. FIG. 3 is a sectional side view of the stirring portion.

As described above, the developing container 22 is provided with the first conveyance path 22*c*, the second conveyance path 22*d*, the partition portion 22*b*, an upstream communication portion 22*e*, and a downstream communication portion 22*f*. In addition, the developing container 22 is provided with a developer replenishing port 22*g*, a developer discharge port 22*h*, an upstream side wall portion 22*i*, and a downstream side wall portion 22*j*. Note that, on the first conveyance path 22*c*, the left side of FIG. 3 is defined as an upstream side and the right side of FIG. 3 as a downstream side; on the second conveyance path 22*d*, the right side of FIG. 3 as an upstream side and the left side of FIG. 3 as a downstream side. Accordingly, in the upstream communication portion 22*e*, the downstream communication portion 22*f*, the upstream side wall portion 22*i*, and the downstream side wall portion 22*j*, the upstream and the downstream are defined by the second conveyance path 22*d* as a reference.

The partition portion 22*b* extends along a long side direction of the developing container 22, and performs partitioning so as to partition the developing container 22 into the first conveyance path 22*c* and the second conveyance path 22*d* parallel with each other. A right end portion in the long side direction of the partition portion 22*b* forms the upstream communication portion 22*e* together with an inner wall portion of the upstream side wall portion 22*i*. Meanwhile, a left end portion in the long side direction of the partition portion 22*b* forms the downstream communication portion 22*f* together with an inner wall portion of the downstream side wall portion 22*j*. The developer is allowed to circulate inside the first conveyance path 22*c*, the upstream communication portion 22*e*, the second conveyance path 22*d*, and the downstream communication portion 22*f*.

The developer replenishing port 22*g* is an opening for replenishing new toner and carrier into the developing container 22 from a developer replenishing container (not shown)

provided to an upper portion of the developing container 22, and is arranged on an upstream side of the first conveyance path 22*c* (left side of FIG. 2).

The developer discharge port 22*h* is an opening for discharging developer which has become surplus due to replenishment of developer in the first conveyance path 22*c* and the second conveyance path 22*d*, and is provided continuously with the second conveyance path 22*d* on a downstream side of the second conveyance path 22*d* in a long side direction thereof.

The first stirring member 43 is arranged in the first conveyance path 22*c*, and the second stirring member 44 is arranged in the second conveyance path 22*d*.

The first stirring member 43 includes a rotary shaft 43*b* and a first helical blade 43*a* provided integrally with the rotary shaft 43*b* and helically formed at a certain blade pitch in an axial direction of the rotary shaft 43*b*. Further, the first helical blade 43*a* is provided so as to extend to both-end-portion sides in a long side direction of the first conveyance path 22*c* and to face also the upstream communication portion 22*e* and the downstream communication portion 22*f*. The rotary shaft 43*b* is rotatably and axially supported by the upstream side wall portion 22*i* and the downstream side wall portion 22*j* of the developing container 22.

The second stirring member 44 includes a rotary shaft 44*b* and a second helical blade 44*a* provided integrally with the rotary shaft 44*b* and helically formed, in an axial direction of the rotary shaft 44*b*, of a (reverse phase) blade directed in a direction reverse to that of the first helical blade 43*a* and having the same blade pitch as that of the first helical blade 43*a*. Further, the second helical blade 44*a* is provided so as to have a length longer than an axial length of the magnetic roller 21, and further, to extend to a position of facing the upstream communication portion 22*e*. The rotary shaft 44*b* is arranged in parallel with the rotary shaft 43*b*, and rotatably and axially supported by the upstream side wall portion 22*i* and the downstream side wall portion 22*j* of the developing container 22.

Further, together with the second helical blade 44*a*, a discharge blade 53, and a decelerating conveyance member 51 and a regulating member 52 which constitute a discharge regulating portion are arranged integrally with the rotary shaft 44*b*.

The decelerating conveyance member 51 is arranged adjacently to a left side of the second helical blade 44*a* so as to face the downstream communication portion 22*f*. Further, the decelerating conveyance member 51 is helically constructed of a plurality of blades directed in the same direction as that of the second helical blade 44*a*, and is set to have a size equal to or smaller than an outer diameter of the second helical blade 44*a* and to have a blade pitch smaller than that of the second helical blade 44*a*. The blade pitch of the decelerating conveyance member 51 is set to from ⅙ to ⅓ of the blade pitch of the second helical blade 44*a*, and the blades thereof face an opening width in a long side direction of the downstream communication portion 22*f*. Note that, although the blades of the decelerating conveyance member 51 may not face the entire width of an opening of the downstream communication portion 22*f*, in this case, it is preferred that blades on a regulating member 52 side face the opening of the downstream communication portion 22*f*.

With this structure, when the rotary shaft 44*b* is rotated, developer is relatively quickly conveyed in the second conveyance path 22*d* by the second helical blade 44*a*. However, the blade pitch of the decelerating conveyance member 51 is smaller than the blade pitch of the second helical blade 44*a*. As a result, in the second conveyance path 22*d* in which the decelerating conveyance member 51 is provided, a conveying speed of the developer is lower than that when the second helical blade 44*a* is provided. Accordingly, although the developer thus conveyed moves in an undulating manner in the second conveyance path 22*d* in conformity with an outer periphery of the blade of the second helical blade 44*a*, when the blade pitch of the helical blade is relatively large, the developer quickly moves while largely fluctuating in height. Meanwhile, when the blade pitch of the helical blade is small as in the case of the decelerating conveyance member 51, fluctuation in height of the developer is small, with the result that the developer slowly moves.

The regulating member 52 enables retention of developer conveyed to the downstream side in the second conveyance path 22*d* and conveyance of developer having exceeded a predetermined volume on the decelerating conveyance member 51 to the developer discharge port 22*h*. The regulating member 52 is constructed of the helical blade provided to the rotary shaft 44*b* and helically constructed of a (reverse phase) blade directed in a direction reverse to that of the second helical blade 44*a*. The regulating member 52 is set to have an outer diameter substantially equal to the outer diameter of the second helical blade 44*a* and to have a blade pitch smaller than that of the second helical blade 44*a*. Further, the regulating member 52 forms a gap of a predetermined size between the inner wall portions of the downstream side wall portion 22*j* and the like of the developing container 22 and an outer peripheral portion of the regulating member 52. As a result, the surplus developer is discharged from the gap.

The rotary shaft 44*b* extends into the developer discharge port 22*h*. The discharge blade 53 is provided on a part of the rotary shaft 44*b*, the part corresponding to an inside of the developer discharge port 22*h*. Although being constructed of a helical blade directed in the same direction as that of the second helical blade 44*a*, the discharge blade 53 has a blade pitch smaller than that of the second helical blade 44*a*, and an outer periphery of the blade smaller than that of the second helical blade 44*a*. Accordingly, the discharge blade 53 is rotated in accordance with rotation of the rotary shaft 44*b*, and the surplus developer conveyed into the developer discharge port 22*h* after climbing over the regulating member 52 is sent to the left side of FIG. 3 and discharged outside the developing container 22. Note that, the discharge blade 53, the regulating member 52, the decelerating conveyance member 51, and the second helical blade 44*a* are molded of a synthetic resin integrally with the rotary shaft 44*b*.

Gears 61 to 64 are arranged on an outer wall of the developing container 22. The gears 61 and 62 are firmly attached to the rotary shaft 43*b*, the gear 64 is firmly attached to the rotary shaft 44*b*, and the gear 63 and other gears (not shown) are rotatably held by the developing container 22 so as to mesh with the gears 62 and 64.

Accordingly, when the gear 61 is rotated by a drive source such as a motor at the time of development without replenishment of new developer, the first helical blade 43*a* is rotated together with the rotary shaft 43*b*. Then, the developer in the first conveyance path 22*c* is conveyed in an arrow P direction by the first helical blade 43*a*, and after that, passes through the upstream communication portion 22*e* so as to be conveyed into the second conveyance path 22*d*. Simultaneously, the second helical blade 44*a* is rotated, and the developer in the second conveyance path 22*d* is conveyed in an arrow Q direction by the second helical blade 44*a*, with the result of being conveyed to the decelerating conveyance member 51. Due to rotation of the first helical blade 43*a* and the second helical blade 44*a*, the developer is relatively quickly conveyed while largely fluctuating in height. Meanwhile, near the decelerating conveyance member 51, rotation of the decelerating conveyance member 51 suppresses fluctuation in height of the developer, and hence the developer is relatively slowly conveyed. Thus, without climbing over the regulating member 52, the developer passes through the downstream communication portion 22*f* so as to be conveyed into the first conveyance path 22*c*.

As described above, the developer is stirred while circulating through the first conveyance path 22*c*, the upstream communication portion 22*e*, the second conveyance path 22*d*, and the downstream communication portion 22*f* in the stated order. After being stirred, the developer is supplied to the magnetic roller 21.

Next, description is made of a case where developer is supplied from the developer replenishing port 22*g*. When toner is consumed by developing, developer including carrier is supplied from the developer replenishing port 22*g* into the first conveyance path 22*c*.

As in the case of the development without replenishment of new developer, the developer thus supplied is conveyed in the first conveyance path 22*c* in the arrow P direction by the first helical blade 43*a*, and after that, passes through the upstream communication portion 22*e* so as to be conveyed into the second conveyance path 22*d*. Further, the developer in the second conveyance path 22*d* is conveyed in the arrow Q direction by the second helical blade 44*a*, with the result of being conveyed to the decelerating conveyance member 51. When the regulating member 52 is rotated in accordance with the rotation of the rotary shaft 44*b*, the regulating member 52 imparts a conveyance force in a direction reverse to a developer conveying direction of the second helical blade 44*a* to the developer. The developer is retained near the decelerating conveyance member 51 by the regulating member 52 and increased in height. Surplus developer climbs over the regulating member 52 so as to be discharged outside the developing container 22 through the developer discharge port 22*h*.

Second Embodiment

Figure 4:
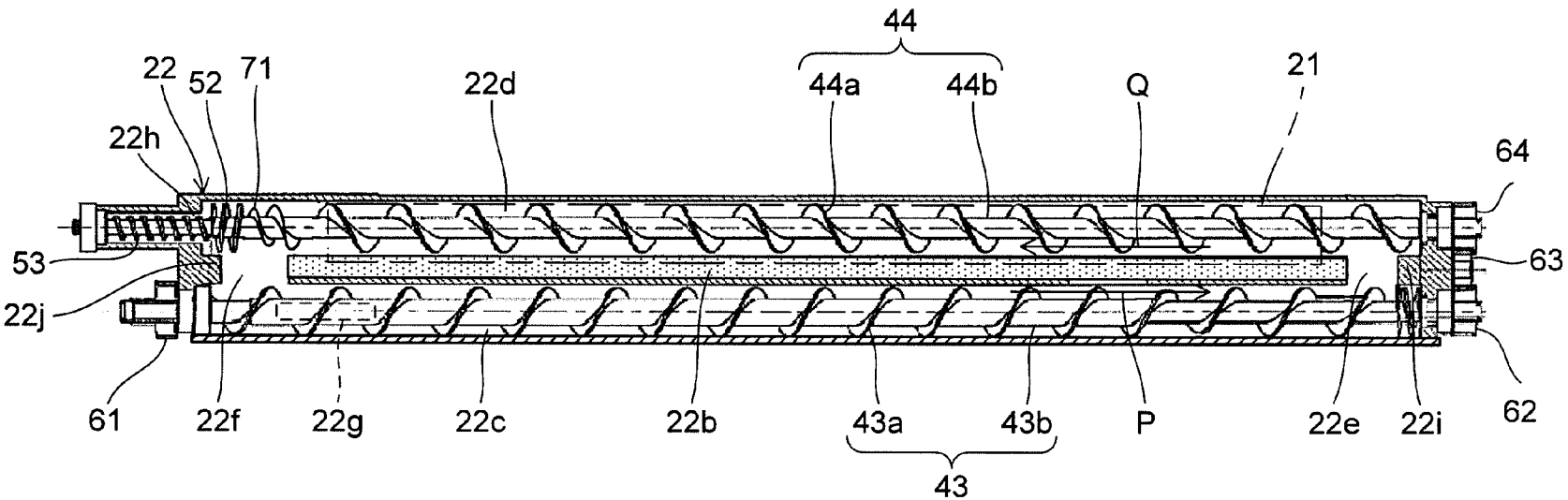
FIG. 4 is a sectional side view of a stirring portion of a developing device according to a second embodiment of the present invention.

FIG. 4 is a sectional side view of a stirring portion of a developing device according to a second embodiment. Description is made mainly of a stirring portion provided with a discharge regulating portion different from that in the first embodiment. Hereinbelow, description of the same parts as those in the first embodiment is omitted.

The first conveyance path 22*c*, the second conveyance path 22*d*, the partition portion 22*b*, the upstream communication portion 22*e*, the downstream communication portion 22*f*, the developer replenishing port 22*g*, and the developer discharge port 22*h* of the developing container 22 are arranged and configured similarly to those in the first embodiment. Further, the first stirring member 43 including the rotary shaft 43*b* and the first helical blade 43*a* is arranged and configured also similarly to those in the first embodiment. Further, the second helical blade 44*a*, the discharge blade 53, and a decelerating conveyance member 71 and the regulating member 52 which constitute a discharge regulating portion are arranged integrally with the rotary shaft 44*b* of the second stirring member 44. Although the second helical blade 44*a*, the regulating member 52, and the discharge blade 53 are arranged and configured similarly to those in the first embodiment, the decelerating conveyance member 71 is configured differently from the decelerating conveyance member 51 in the first embodiment.

The decelerating conveyance member 71 is arranged adjacently to the left side of the second helical blade 44*a* so as to face the downstream communication portion 22*f*. Further, the decelerating conveyance member 71 is helically constructed of a blade directed in the same direction as that of the second helical blade 44*a*, and is set to have a size smaller than the outer diameter of the second helical blade 44*a* and to have a blade pitch smaller than that of the second helical blade 44*a*. The number of blades of the decelerating conveyance member 71 is one, and the one blade faces the downstream communication portion 22*f*. Note that, the blade pitch of the decelerating conveyance member 71 may be equal to the blade pitch of the second helical blade 44*a*. Further, the decelerating conveyance member 71 may be constructed of a plurality of blades, and those blades may face the opening width in the long side direction of the downstream communication portion 22*f*. Further, although the blades of the decelerating conveyance member 71 may not face the entire width of the opening of the downstream communication portion 22*f*, in this case, it is preferred that the blades on the regulating member 52 side face the opening of the downstream communication portion 22*f*.

With this structure, when the rotary shaft 44*b* is rotated, developer is relatively quickly conveyed in the second conveyance path 22*d* by the second helical blade 44*a*. However, the outer diameter of the blade of the decelerating conveyance member 71 is smaller than the outer diameter of the second helical blade 44*a*. As a result, in the second conveyance path 22*d* in which the decelerating conveyance member 71 is provided, a conveying speed of the developer is lower than that when the second helical blade 44*a* is provided. Accordingly, although the developer thus conveyed moves in an undulating manner in the second conveyance path 22*d* in conformity with an outer periphery of the blade of the second helical blade 44*a*, when the outer diameter of the helical blade is relatively large, the developer quickly moves while largely fluctuating in height. Meanwhile, when the outer diameter of the blade is small as in the case of the decelerating conveyance member 71, fluctuation in height of the developer is small, with the result that the developer slowly moves.

Accordingly, when the gear 61 is rotated by a drive source such as a motor at the time of development without replenishment of new developer, the first helical blade 43*a* is rotated together with the rotary shaft 43*b*. Then, the developer in the first conveyance path 22*c* is conveyed in the arrow P direction by the first helical blade 43*a*, and after that, passes through the upstream communication portion 22*e* so as to be conveyed into the second conveyance path 22*d*. Simultaneously, the second helical blade 44*a* is rotated, and the developer in the second conveyance path 22*d* is conveyed in the arrow Q direction by the second helical blade 44*a*, with the result of being conveyed to the decelerating conveyance member 71. Due to rotation of the first helical blade 43*a* and the second helical blade 44*a*, the developer is relatively quickly conveyed while largely fluctuating in height. Meanwhile, near the decelerating conveyance member 71, rotation of the decelerating conveyance member 71 suppresses fluctuation in height of the developer, and hence the developer is relatively slowly conveyed. Thus, without climbing over the regulating member 52, the developer passes through the downstream communication portion 22*f* so as to be conveyed into the first conveyance path 22*c*.

As described above, the developer is stirred while circulating through the first conveyance path 22*c*, the upstream communication portion 22*e*, the second conveyance path 22*d*, and the downstream communication portion 22*f* in the stated order. After being stirred, the developer is supplied to the magnetic roller 21.

Next, description is made of a case where developer is supplied from the developer replenishing port 22*g*. When toner is consumed by developing, developer including carrier is supplied from the developer replenishing port 22*g* into the first conveyance path 22*c*.

As in the case of the development without replenishment of new developer, the developer thus supplied is conveyed in the first conveyance path 22*c* in the arrow P direction by the first helical blade 43*a*, and after that, passes through the upstream communication portion 22*e* so as to be conveyed into the second conveyance path 22*d*. Further, the developer in the second conveyance path 22*d* is conveyed in the arrow Q direction by the second helical blade 44*a*, with the result of being conveyed to the decelerating conveyance member 71. When the regulating member 52 is rotated in accordance with the rotation of the rotary shaft 44*b*, the regulating member 52 imparts a conveyance force in a direction reverse to a developer conveying direction of the second helical blade 44*a* to the developer. The developer is retained near the decelerating conveyance member 71 by the regulating member 52 and increased in height. Surplus developer climbs over the regulating member 52 so as to be discharged outside the developing container 22 through the developer discharge port 22*h*.

According to the first and second embodiments, the developing device 2 includes the developing roller 20 for supplying developer to the photosensitive member 11, and the stirring member 42 which includes the first helical blade 43*a* and the second helical blade 44*a* respectively extending about the rotary shaft 43*b* and the rotary shaft 44*b* in the axial directions thereof and stirs and conveys the developer to be supplied to the developing roller 20. The developing container 22 is provided with the partition portion 22*b* for partitioning the developing container 22 into the first conveyance path 22*c* and the second conveyance path 22*d* in which developer is circulatingly conveyed by the stirring member 42, the upstream communication portion 22*e* and the downstream communication portion 22*f* for communicating the first conveyance path 22*c* and the second conveyance path 22*d* with each other on the both-end-portion sides in the long side direction of the partition portion 22*b*, the developer replenishing port 22*g* from which the developer is supplied, and the developer discharge port 22*h* which is provided on the downstream side of the second conveyance path 22*d* (one conveyance path) and from which surplus developer is discharged. The discharge regulating portion is provided to the second stirring member 44 (stirring member) arranged in the second conveyance path 22*d*. The discharge regulating portion is provided with the regulating member 52 arranged so as to face the developer discharge port 22*h*, for regulating movement of developer to a developer discharge port 22*h* side, and the decelerating conveyance member 51 (or 71) arranged between the second helical blade 44*a* and the regulating member 52, partially reducing the conveying speed of developer in the second conveyance path 22*d*, and conveying the developer through the downstream communication portion 22*f* (communication portion) to the first conveyance path 22*c*.

With this structure, developer is supplied from the developer replenishing port 22*g* into the developing container 22, and the developer is conveyed while being stirred by the stirring member 42. Then, the developer thus conveyed moves to the downstream side of the second conveyance path 22*d* and is retained by the regulating member 52, and surplus developer having exceeded the height of the regulating member 52 overflows from the outer peripheral portion of the regulating member 52 into the developer discharge port 22*h*. Accordingly, the surplus developer can be stably discharged outside the developing container 22 from the developer discharge port 22*h*. Meanwhile, when new developer is not replenished, the developer conveyed as described above moves to the downstream side of the second conveyance path 22*d* in an undulating manner in conformity with the outer periphery of the second helical blade 44*a* of the second stirring member 44, and collides against the regulating member 52. When the developer moving in the undulating manner and having the height collides against the regulating member 52, the conveying speed of the developer is reduced by the decelerating conveyance member 51 (or 71). Thus, even when the stirring member 42 is rotated at high speed, the developer is prevented from splashing, and hence does not climb over the outer peripheral portion of the regulating member 52. Accordingly, a developer amount in the developing container 22 can be accurately maintained to a desired amount, and it is unnecessary to separate the regulating member 52 from the second helical blade 44*a*. As a result, the developing device can be downsized.

Further, according to the first and second embodiments, the regulating member 52 is constructed of the helical blade helically formed in a reverse phase with respect to the second helical blade 44*a* of the second stirring member 44. With this, when the regulating member 52 constructed of the reverse-phase helical blade is rotated in the same direction as that of the second helical blade 44*a*, the regulating member 52 imparts the conveyance force in the direction reverse to the developer conveying direction of the second helical blade 44*a* to the developer. The developer is retained on the downstream side of the second conveyance path 22*d* by the regulating member 52 and increased in height, and surplus developer climbs over the regulating member 52 so as to move to the developer discharge port 22*h*. Thus, developer is discharged by an appropriate amount.

Still further, according to the first and second embodiments, the decelerating conveyance member 51 (or 71) is arranged so as to face the downstream communication portion 22*f*. With this, when new developer is not replenished, the developer retained by the regulating member 52 is reliably conveyed, without being conveyed to the developer discharge port 22*h*, from the second conveyance path 22*d* to the downstream communication portion 22*f* by the rotation of the decelerating conveyance member 51 (or 71), and conveyed further to a first conveyance path 22*c* side. In addition, the developer is conveyed from the second conveyance path 22*d* to the first conveyance path 22*c* even when the opening width in the long side direction of the downstream communication portion 22*f* is narrow. Thus, the developing device is downsized in the long side direction.

Yet further, according to the first and second embodiments, the developing container 22 is provided with the downstream side wall portion 22*j* forming the downstream communication portion 22*f* together with the partition portion 22*b*, and the gap is formed between the downstream side wall portion 22*j* and the outer peripheral portion of the regulating member 52. With this, the developer increased in height as a result of being retained by the regulating member 52 is conveyed into the gap between the outer peripheral portion of the regulating member 52 and the side wall portion of the developing container 22, and overflows from the gap into the developer discharge port 22*h*. Thus, there is no risk of excessive discharge of the developer. Further, the downstream side wall portion 22*j* forms the gap for discharging surplus developer and also forms the downstream communication portion 22*f*. Thus, without provision of a special member, a structurally simple and inexpensive developing container 22 can be provided.

Yet further, according to the first and second embodiments, the decelerating conveyance member 51 (or 71) is formed integrally with the second helical blade 44*a* together with the regulating member 52. Thus, the decelerating conveyance member 51 (or 71), the regulating member 52, and the second helical blade 44*a* can be molded of a synthetic resin integrally with each other through intermediation of the rotary shaft 44*b*, which leads to cost reduction.

Further, according to the first embodiment, the decelerating conveyance member 51 is a helical blade having the blade pitch smaller than that of the second helical blade 44*a* of the second stirring member 44. When the blade pitch of the helical blade as the decelerating conveyance member 51 is small, the conveying speed of the developer on the decelerating conveyance member 51 is lower than the conveying speed of the developer on the second helical blade 44*a*. Thus, even when the developer collides against the regulating member 52, the developer is prevented from splashing, and hence does not climb over the outer peripheral portion of the regulating member 52. Accordingly, with a simple structure, the developer amount in the developing container 22 can be accurately maintained to a desired amount. When the blade pitch of the decelerating conveyance member 51 is set to from ⅙ to ⅓ of the blade pitch of the second helical blade 44*a*, the developer is more satisfactorily prevented from splashing.

Further, according to the second embodiment, the decelerating conveyance member 71 is a helical blade having the outer diameter smaller than that of the second helical blade 44*a* of the second stirring member 44. When the outer diameter of the helical blade as the decelerating conveyance member 71 is small, the conveying speed of the developer on the decelerating conveyance member 71 is lower than the conveying speed of the developer on the second helical blade 44*a*. Thus, even when the developer collides against the regulating member 52, the developer is prevented from splashing, and hence does not climb over the outer peripheral portion of the regulating member 52. Accordingly, with a simple structure, the developer amount in the developing container 22 can be accurately maintained to a desired amount.

Next, description is made of first and second examples in which the first and second embodiments are further specified and comparison examples A and B. Note that, the present invention is not limited only to the following examples.

The developing roller 20 used in each of the first and second examples and the comparison examples A and B has an outer diameter of 16 mm and is rotated at 700 rpm, and the magnetic roller 21 has an outer diameter of 20 mm and is rotated at 878 rpm. In the first stirring member 43, the first helical blade 43*a* has an outer diameter of 18 mm, the blade pitch is 30 mm (two-row winding), and further, the rotary shaft 43*b* has a shaft diameter of 7 mm and is rotated at 500 rpm. Meanwhile, the outer diameter of the second helical blade 44*a* of the second stirring member 44 is 18 mm, the blade pitch is 30 mm (two-row winding), and further, a shaft diameter of the rotary shaft 44*b* is 7 mm and is reverse-rotated with respect to the first helical blade 43*a* at 500 rpm. The opening width of the downstream communication portion 22*f* of the developing container 22 is 30 mm.

Toner in the developing container 22 has an average particle diameter of 6.8 μm, carrier has an average particle diameter of 35 μm, and weight percentage of the toner with respect to the carrier is 9%. In new developer replenished into the developing container 22, weight percentage of carrier with respect to toner is 10%. Four hundred grams of the developer are stored in the developing container 22 (first conveyance path 22*c* and second conveyance path 22*d*), the amount of 400 g being a predetermined amount excluding surplus developer from the developing container 22.

In the developing device structured as described above, evaluation of a developer scattering amount at the discharge portion is made in accordance with presence or absence of the decelerating conveyance member 51 (or 71). Note that, the developer scattering amount is an amount of developer conveyed from inside the first conveyance path 22*c* and the second conveyance path 22*d* into the developer discharge port 22*h*.

In the first example, as illustrated in FIG. 3, a helical blade having a blade pitch smaller than that of the second helical blade 44*a* is used as the decelerating conveyance member 51, which has a blade diameter of 18 mm, the blade pitch of 5 mm, and three blades.

In the second example, as illustrated in FIG. 4, a helical blade having an outer diameter smaller than that of the second helical blade 44*a* is used as the decelerating conveyance member 71, which has the blade diameter of 12 mm, and one blade.

Figure 5:
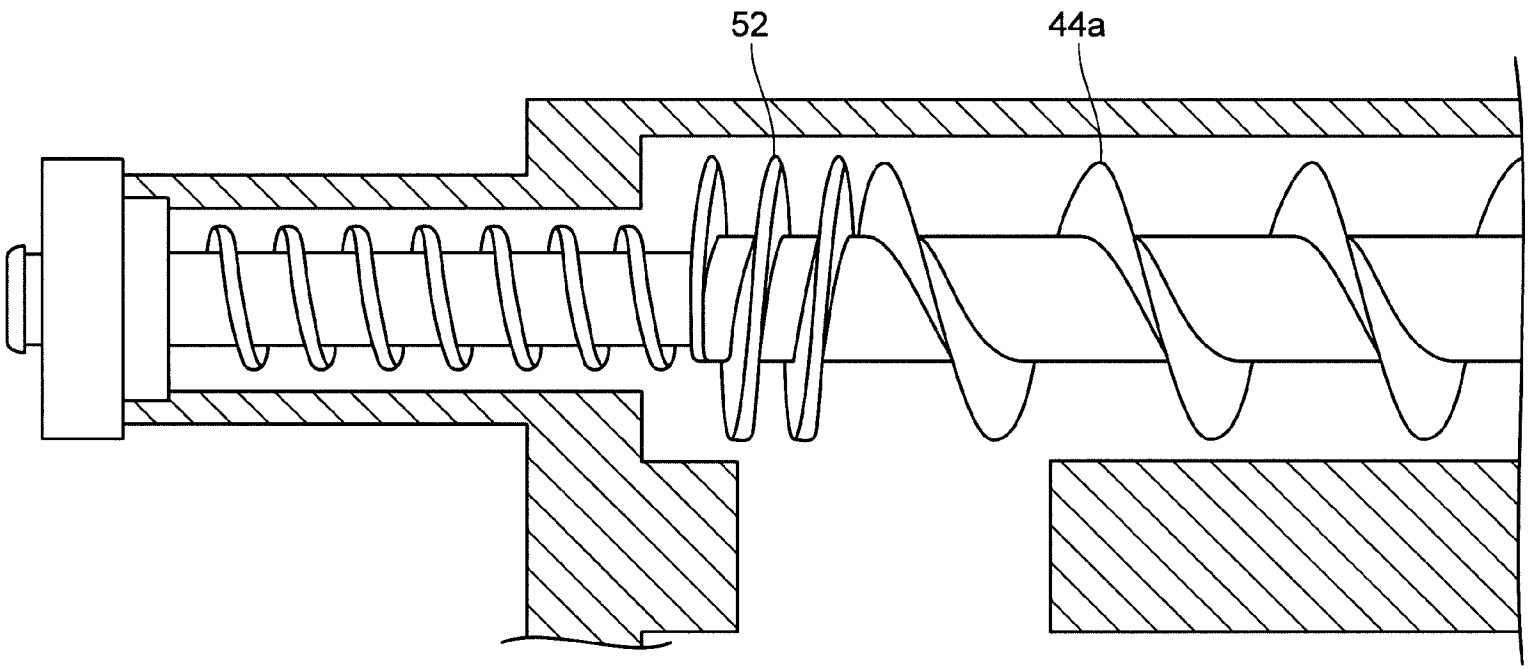
FIG. 5 is a sectional side view of a developer discharge portion of a developing device according to a comparison example of the present invention.
Figure 6:
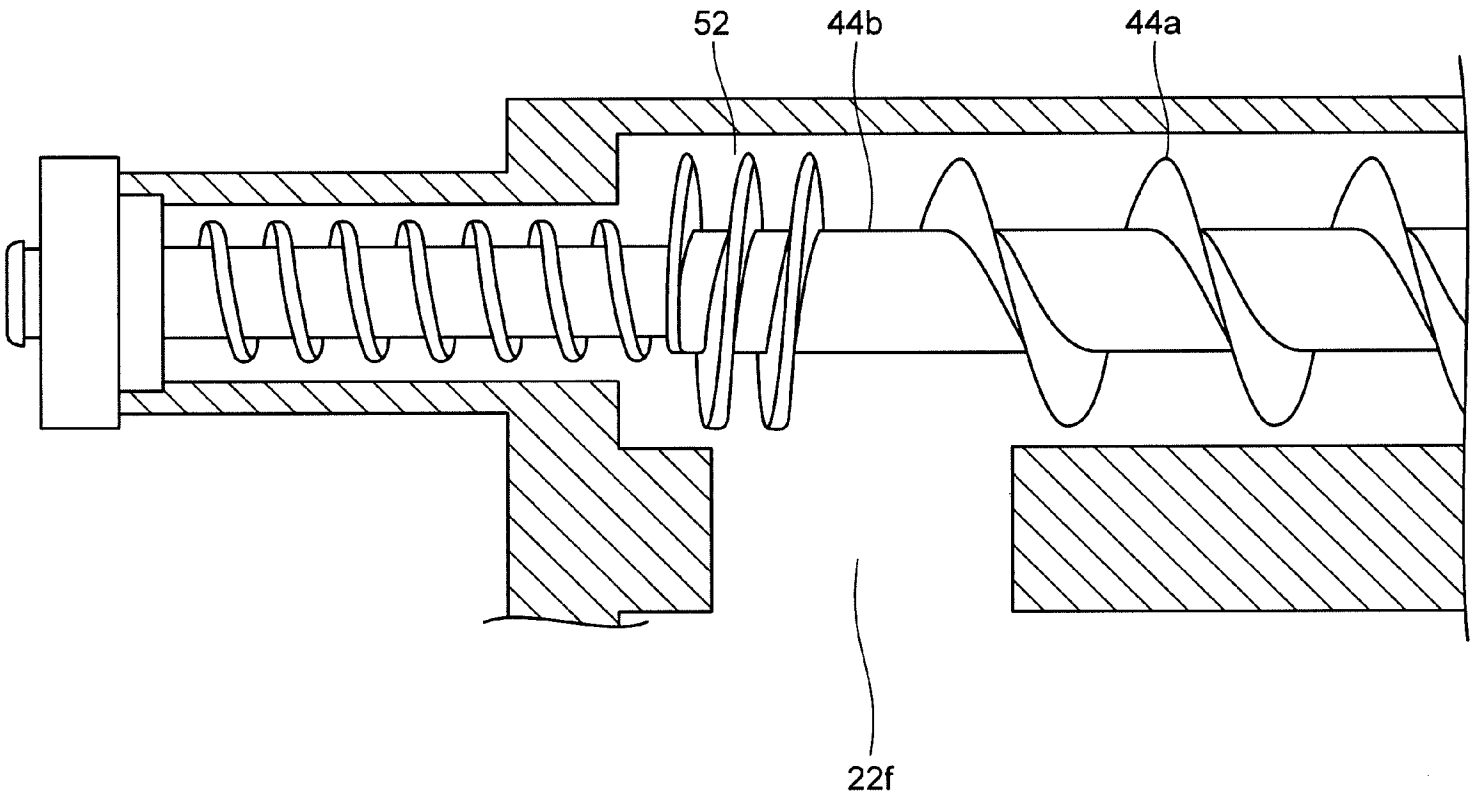
FIG. 6 is a sectional side view of a developer discharge portion of a developing device according to another comparison example of the present invention.

In the comparison example A, as illustrated in FIG. 5, the second helical blade 44*a* extends to the regulating member 52. Further, in the comparison example B, as illustrated in FIG. 6, the second helical blade 44*a* and the regulating member 52 are provided to the rotary shaft 44*b*, and the decelerating conveyance member 51 (or 71) is not provided thereto. The rotary shaft 44*b* faces to the downstream communication portion 22*f*. However, at a portion of the rotary shaft 44*b* facing to the downstream communication portion 22*f*, the second helical blade 44*a* and the regulating member 52 are not arranged.

Figure 7:
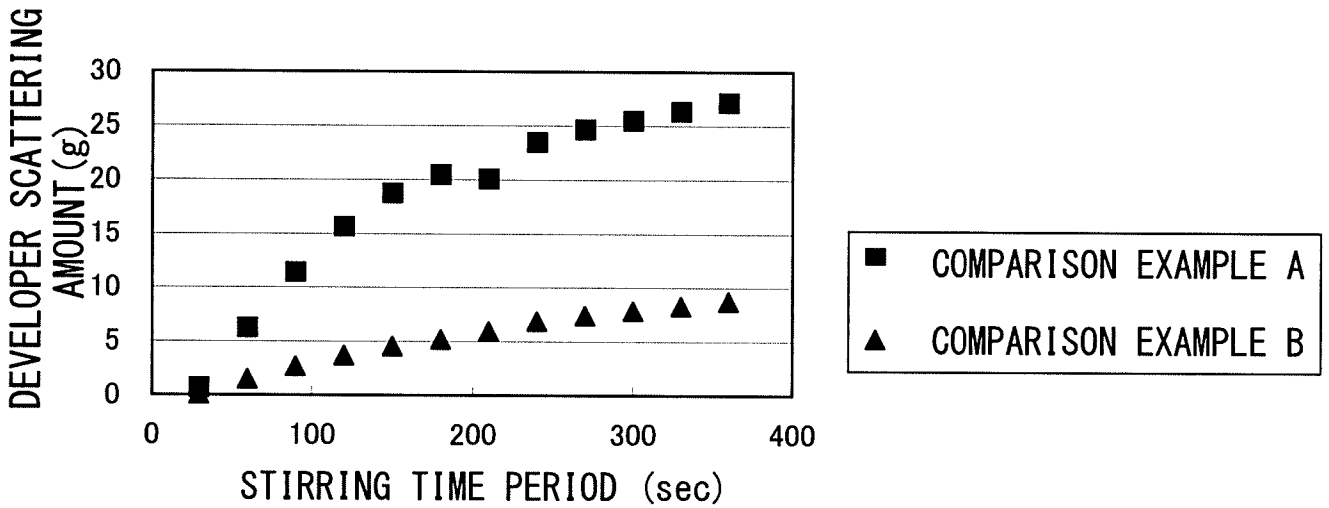
FIG. 7 is a graph showing developer scattering at the developer discharge portion according to each of the comparison examples of the present invention.
Figure 8:
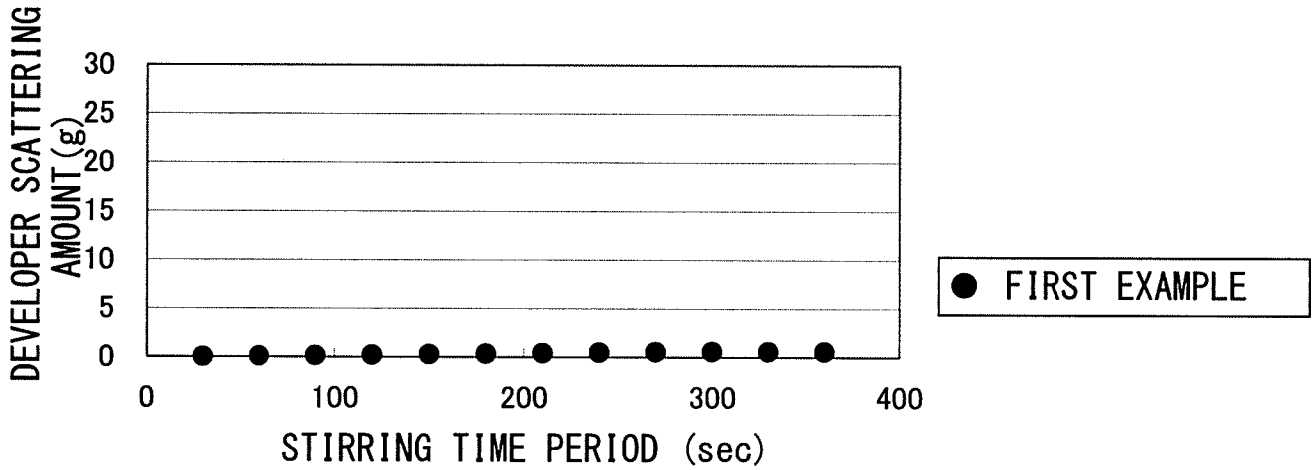
FIG. 8 is a graph showing developer scattering at a developer discharge portion according to a first example of the present invention.
Figure 9:
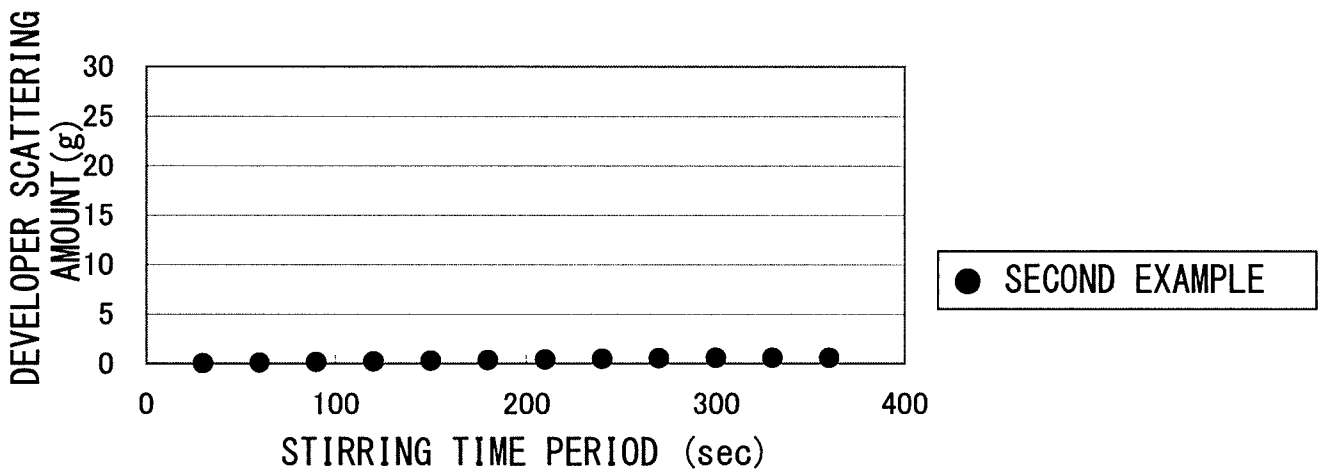
FIG. 9 is a graph showing developer scattering at a developer discharge portion according to a second example of the present invention.

FIG. 7 shows evaluation results of developer scattering amounts of the comparison examples A and B, and FIGS. 8 and 9 show evaluation results of developer scattering amounts of the first and second examples. FIGS. 7 to 9 are graphs in each of which the abscissa axis represents a stirring time period (measured in sec) and the ordinate axis represents the developer scattering amounts (measured in g).

In the comparison example A shown in FIG. 7, developer is conveyed to a front side of the regulating member 52 by the second helical blade 44*a*, and is stopped. The stopped developer is pushed out to the developer discharge port 22*h* side by developer conveyed from the upstream side, and is splashed by the rotation of the second helical blade 44*a* so as to move to the developer discharge port 22*h* side after climbing over the outer peripheral portion of the regulating member 52. As a result, the developer scattering amount increases in proportion to the stirring time period.

In the comparison example B shown in FIG. 7, developer is conveyed to the front side of the regulating member 52 by the second helical blade 44*a*, and is stopped. Although the stopped developer is pushed out to the developer discharge port 22*h* side by developer conveyed from the upstream side, the developer does not splash. Thus, the developer scattering amount is small in comparison with that of the comparison example A. However, the developer scattering amount increases in proportion to the stirring time period.

In the first and second examples, as illustrated in FIGS. 8 and 9, the developer scattering hardly occurred even the stirring time period was prolonged, which showed satisfactory results.

Third Embodiment

Figure 10:
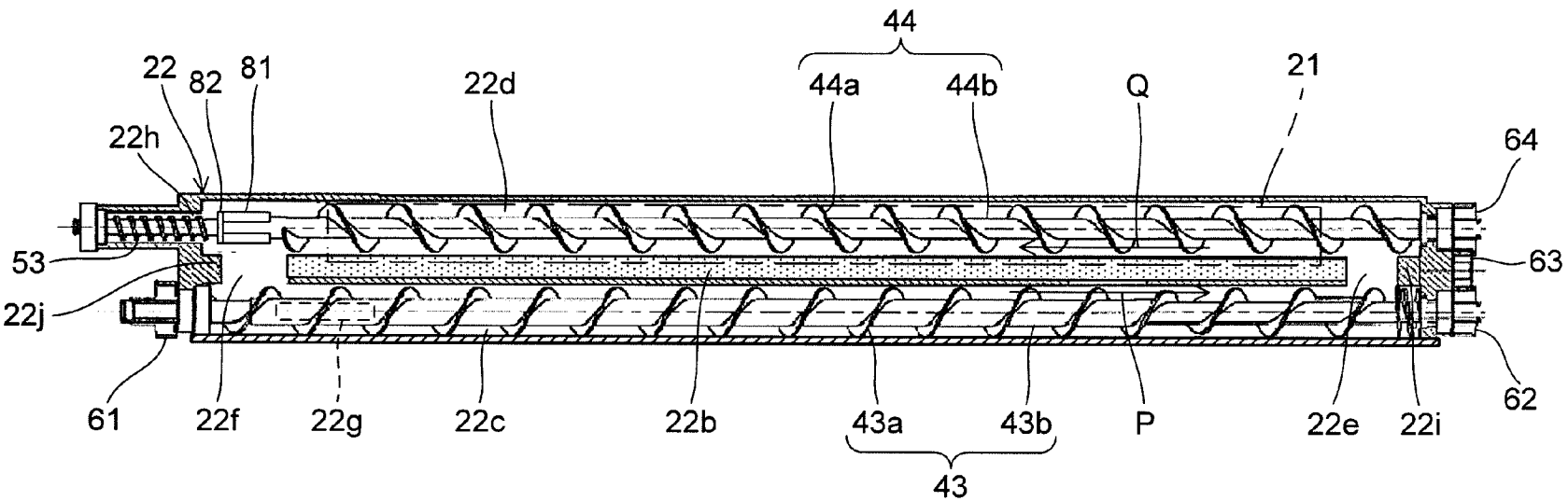
FIG. 10 is a sectional side view of a stirring portion of a developing device according to a third embodiment of the present invention.

FIG. 10 is a sectional side view of a stirring portion of a developing device according to a third embodiment. Description is made mainly of a stirring portion provided with a discharge regulating portion different from that in the first embodiment.

The first conveyance path 22*c*, the second conveyance path 22*d*, the partition portion 22*b*, the upstream communication portion 22*e*, the downstream communication portion 22*f*, the developer replenishing port 22*g*, and the developer discharge port 22*h* of the developing container 22 are arranged and configured similarly to those in the first embodiment. Further, the first stirring member 43 including the rotary shaft 43*b* and the first helical blade 43*a* is arranged and configured also similarly to those in the first embodiment. Further, the second helical blade 44*a*, the discharge blade 53, and a conveying blade 81 and the plate member 82 which constitute a discharge regulating portion are arranged integrally with the rotary shaft 44*b* of the second stirring member 44. Although the second helical blade 44*a*, and the discharge blade 53 are arranged and configured similarly to those in the first embodiment, the conveying blade 81 and the plate member 82 are configured differently from the first embodiment.

The conveying blade 81 is arranged adjacently to the left side of the second helical blade 44*a* so as to face the downstream communication portion 22*f*. Further, the conveying blade 81 is constructed of from four to six rectangular sheet members, with flat surface portions thereof extending in the axial direction of the rotary shaft 44*b* and being arranged radially about the rotary shaft 44*b*. With this structure, rotation of the conveying blade 81 causes the developer conveyed to the downstream side in the second conveyance path 22*d* to be conveyed from the downstream communication portion 22*f* to the first conveyance path 22*c*. Note that, the conveying blade 81 is formed of a resin or a metal integrally with the shaft portion, and is firmly and coaxially attached to another shaft portion on a second helical blade 44*a* side. Alternatively, the conveying blade 81 is formed integrally with the rotary shaft 44*b* together with the second helical blade 44*a*.

The plate member 82 enables retention of the developer conveyed to the downstream side in the second conveyance path 22*d* and conveyance of developer having exceeded a predetermined volume on the conveying blade 81 to the developer discharge port 22*h*. The plate member 82 is constructed of a small disk plate (having thickness of 2 mm or less) having a diameter substantially equal to an outer periphery of an imaginary circle obtained by connecting radially outer ends of the sheet members of the conveying blade 81 and a relatively small axial width. The plate member 82 is provided on the developer discharge port 22*h* side of the conveying blade 81 so as to be held in close contact with the conveying blade 81. The plate member 82 is formed of a resin or a metal integrally with the conveying blade 81. Note that, instead of being provided on a plane perpendicular to an axial direction of the rotary shaft 44*b* so as to be held in close contact with the conveying blade 81, the plate member 82 may be provided to the rotary shaft 44*b* while being separated from the conveying blade 81, and further, may be provided in an inclined manner with respect to the rotary shaft 44*b*.

The rotary shaft 44*b* extends into the developer discharge port 22*h*. The discharge blade 53 is provided on a part of the rotary shaft 44*b*, the part corresponding to the inside of the developer discharge port 22*h*. Although being constructed of the helical blade directed in the same direction as that of the second helical blade 44*a*, the discharge blade 53 has the blade pitch smaller than that of the second helical blade 44*a*, and the outer periphery of the blade smaller than that of the second helical blade 44*a*. Accordingly, the discharge blade 53 is rotated in accordance with rotation of the rotary shaft 44*b*, and surplus developer conveyed into the developer discharge port 22*h* after climbing over the plate member 82 is sent to the left side of FIG. 10 and discharged outside the developing container 22.

Figure 11:
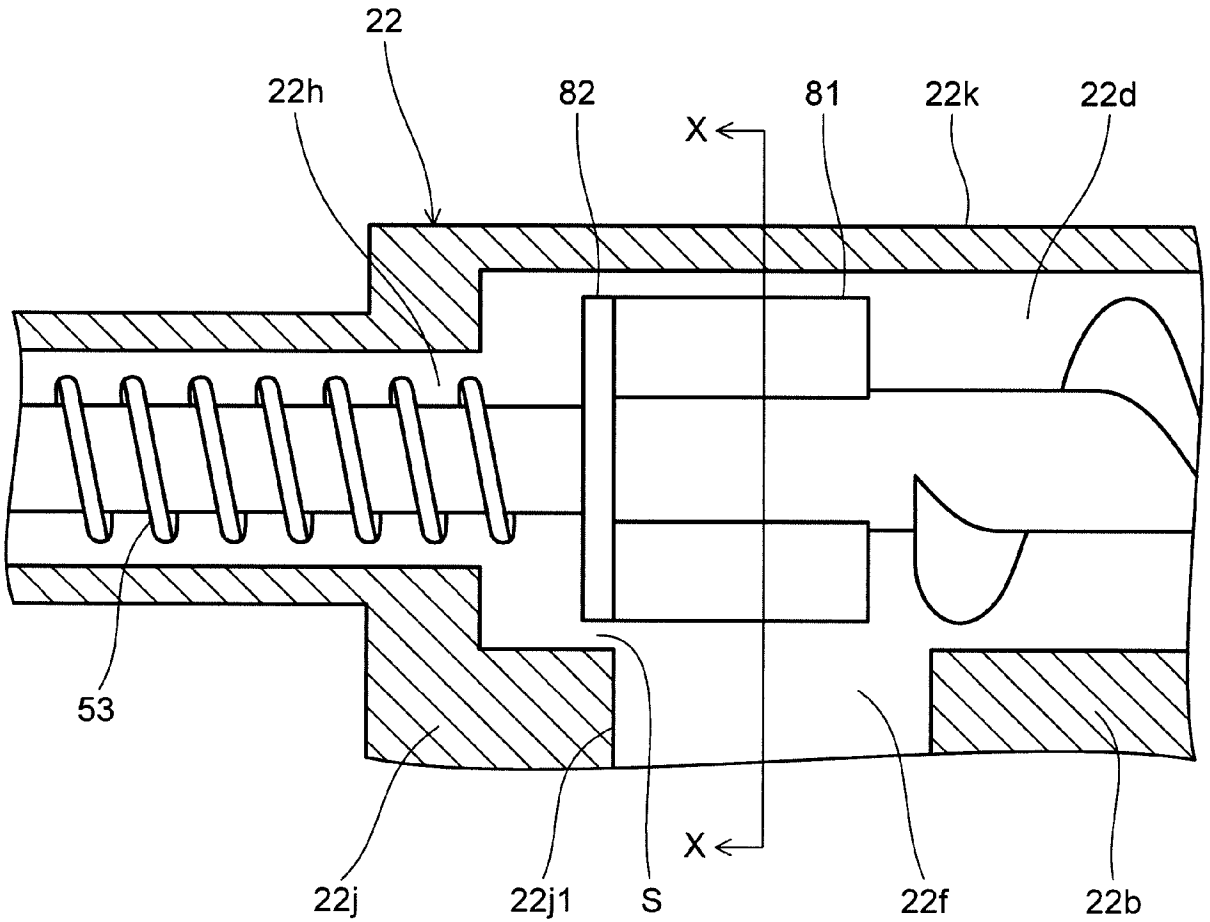
FIG. 11 is a sectional side view of a developer discharge portion of the developing device according to the third embodiment of the present invention.
Figure 12:
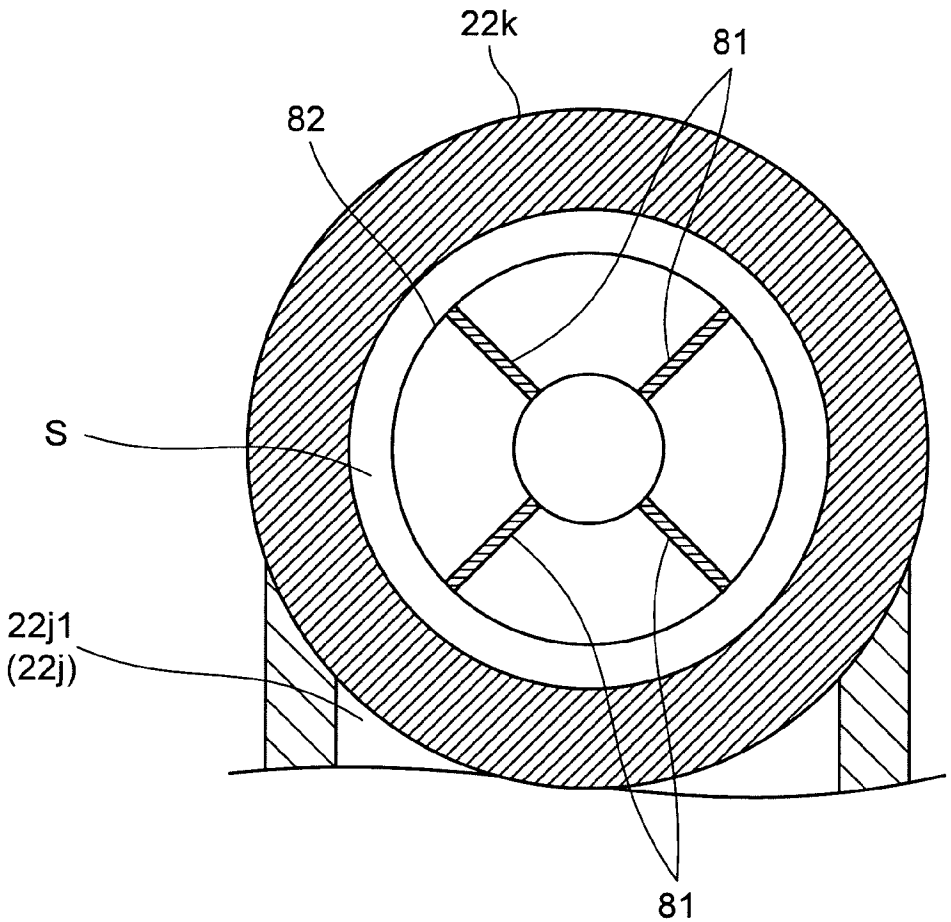
FIG. 12 is a sectional view taken along the direction of X-X of FIG. 11, illustrating the developer discharge portion of the developing device according to the third embodiment of the present invention.

Detailed description is made of discharge of the surplus developer with reference to FIGS. 11 and 12. FIG. 11 is a sectional side view of a developer discharge portion, and FIG. 12 is a sectional view taken along the direction of X-X of FIG. 11, illustrating the developer discharge portion viewed from a developer discharge port side.

As illustrated in FIG. 11, the plate member 82 is arranged in a space surrounded by the downstream side wall portion 22*j* and a front wall portion 22*k* in the second conveyance path 22*d*. A regulation space thus defined is formed in a substantially cylindrical shape (refer to FIG. 12).

The developer discharge port 22*h* has a space for accommodating the discharge blade 53, and the discharge port space is formed in a cylindrical shape. The discharge port has an inner diameter smaller than an inner diameter of the regulation space and smaller than an outer periphery of the plate member 82. Further, a gap S is formed between the regulation space and the plate member 82. In addition, an end surface 22*j*1 of the downstream side wall portion 22*j* is axially flush with a surface on a conveying blade 81 side of the plate member 82. In other words, in the downstream side wall portion 22*j*, the gap S is formed in the axial direction by a length corresponding to a width of the plate member 82 (plate thickness). Note that, the end surface 22*j*1 of the downstream side wall portion 22*j* forms the downstream communication portion 22*f* together with an end surface of the partition portion 22*b*.

Accordingly, as illustrated in FIG. 12, the plate member 82 forms the gap S over the entire periphery with respect to the downstream side wall portion 22*j* and the front wall portion 22*k*. The surplus developer conveyed in the second conveyance path 22*d* to the conveying blade 81 overflows from the gap S into the developer discharge port 22*h*.

Note that, as described above in this embodiment, although the end surface 22*j*1 of the downstream side wall portion 22*j* is flush with the surface on the upstream side of the plate member 82 and the gap S is formed in the axial direction by the length corresponding to the width of the plate member 82, the present invention is not limited thereto. The end surface 22*j*1 may form the gap S between an upstream side surface and a downstream side surface of the plate member 82 (on the axial width of the plate member 82).

According to the third embodiment, the developing device 2 includes the developing roller 20 for supplying developer to the photosensitive member 11, and the stirring member 42 which includes the first helical blade 43*a* and the second helical blade 44*a* respectively extending about the rotary shaft 43*b* and the rotary shaft 44*b* in the axial directions thereof and stirs and conveys the developer to be supplied to the developing roller 20. The developing container 22 is provided with the partition portion 22*b* for partitioning the developing container 22 into the first conveyance path 22*c* and the second conveyance path 22*d* in which developer is circulatingly conveyed by the stirring member 42, the upstream communication portion 22*e* and the downstream communication portion 22*f* for communicating the first conveyance path 22*c* and the second conveyance path 22*d* with each other on the both-end-portion sides in the long side direction of the partition portion 22*b*, the developer replenishing port 22*g* from which the developer is supplied, and the developer discharge port 22*h* which is provided on the downstream side of the second conveyance path 22*d* (one conveyance path) and from which surplus developer is discharged. The discharge regulating portion is provided to the second stirring member 44

(stirring member) arranged in the second conveyance path 22*d*. The discharge regulating portion is formed between the second helical blade 44*a* and the developer discharge port 22*h*, and includes the conveying blade 81 for conveying the developer through the downstream communication portion (communication portion) 22*f* from the second conveyance path 22*d* to the first conveyance path 22*c* and the plate member 82 provided on a developer discharge port 22*h* side of the conveying blade 81 for the purpose of regulating movement of the developer to the developer discharge port 22*h* side. The plate member 82 is arranged so that an outer peripheral surface thereof forms the gap S with respect to the downstream side wall portion 22*j* (side wall portion) and the end surface 22*j*1 of the downstream side wall portion 22*j* is positioned between the upstream side and the downstream side in the axial direction of the plate member 82 (on the axial width of the plate member 82).

With this structure, the developer is replenished from the developer replenishing port 22*g* into the developing container 22. Then, the developer replenished into the developing container 22 is conveyed while being stirred by the stirring member 42, with the result of being moved to the downstream side of the second conveyance path 22*d*. On the downstream side, the developer is retained by the plate member 82, and conveyed, without being conveyed into the developer discharge port 22*h*, from the downstream communication portion 22*f* to the first conveyance path 22*c* by the rotation of the conveying blade 81. However, the developer having exceeded the height of the plate member 82 is conveyed into the gap S between the outer peripheral surface of the plate member 82 and the downstream side wall portion 22*j*, and overflows as surplus developer from the gap S into the developer discharge port 22*h*. Accordingly, with a simple structure in which the plate member 82 has a plate-like shape, the developing device can be downsized and the surplus developer can be stably discharged outside the developing container 22 from the developer discharge port 22*h*.

Further, according to the third embodiment, the conveying blade 81 is provided to the rotary shaft 44*b*, and the plate member 82 is provided in contact with the conveying blade 81. As a result, the developing device is downsized in the long side direction.

Still further, according to the third embodiment, the plate member 82 is constructed of a disk plate. Thus, the developer retained by the plate member 82 is substantially uniform in height in a peripheral direction of the rotary shaft 44*b*, and hence does not unnecessarily climb over the plate member 82. As a result, the developer on the conveying blade 81 is stably conveyed to the downstream communication portion 22*f*, and the surplus developer stably overflows from the gap S into the developer discharge port 22*h*.

Yet further, according to the third embodiment, the conveying blade 81 is constructed of a plurality of sheet members arranged radially about the rotary shaft 44*b* and having the flat surface portions extending in the axial direction of the rotary shaft 44*b*, and has an outer diameter substantially equal to an outer diameter of the plate member 82. As just described above, the conveying blade 81 is constructed of the plurality of sheet members having the flat surface portions extending in the axial direction of the rotary shaft 44*b*. Thus, when the conveying blade 81 is rotated, the developer on the conveying blade 81 is reliably and quickly conveyed to the downstream communication portion 22*f*. Further, the plate member 82 has the outer diameter substantially equal to the outer diameter of the conveying blade 81. Thus, the developer retained by the plate member 82 does not unnecessarily climb over the plate member 82, and the developer on the conveying blade 81 is stably conveyed to the downstream communication portion 22*f*. Further, the surplus developer stably overflows from the gap S into the developer discharge port 22*h*.

Yet further, according to the third embodiment, the downstream side wall portion 22*j* forms the downstream communication portion 22*f* together with the partition portion 22*b*. With this, the downstream side wall portion 22*j* forms the gap S for discharging the surplus developer and a part of the downstream communication portion 22*f*. Thus, without provision of a special member, a structurally simple and inexpensive developing container 22 can be provided.

Next, description is made of a third example in which the third embodiment is further specified and comparison examples C and D. Note that, the present invention is not limited only to the following examples.

The developing roller 20 used in each of the third example and the comparison examples C and D has an outer diameter of 16 mm and is rotated at 630 rpm, and the magnetic roller 21 has an outer diameter of 20 mm and is rotated at 800 rpm. In the first stirring member 43, the first helical blade 43*a* has an outer diameter of 20 mm, the blade pitch is 30 mm (two-row winding), and further, the rotary shaft 43*b* has a shaft diameter of 7 mm and is rotated at 470 rpm. Meanwhile, the outer diameter of the second helical blade 44*a* of the second stirring member 44 is 20 mm, the blade pitch is 30 mm (two-row winding), and further, a shaft diameter of the rotary shaft 44*b* is 7 mm and is reverse-rotated with respect to the first helical blade 43*a* at 470 rpm. The conveying blade 81 has four blades and is rotated at 470 rpm. The plate member 82 is a disk plate having an outer diameter of 20 mm and a width of 2 mm.

Toner in the developing container 22 has an average particle diameter of 6.8 μm, carrier has an average particle diameter of 35 μm, and weight percentage of the toner with respect to the carrier is 9%. In new developer replenished into the developing container 22, weight percentage of carrier with respect to toner is 10%. Four hundred grams of the developer are stored in the developing container 22 (first conveyance path 22*c* and second conveyance path 22*d*), the amount of 400 g being a predetermined amount excluding surplus developer from the developing container 22.

In the developing device according to the third example and the comparison examples C and D structured as described above, evaluation of a developer scattering amount at the discharge portion is made with the positions of the downstream side wall portion 22*j* in the long side direction (axial direction) with respect to the plate member 82 being made to be different from each other. Note that, the developer scattering amount is an amount of developer conveyed from inside the first conveyance path 22*c* and the second conveyance path 22*d* into the developer discharge port 22*h*.

In the third example, as illustrated in FIG. 11, the end surface 22*j*1 of the downstream side wall portion 22*j* is flush with the surface on the conveying blade 81 side of the plate member 82, and the gap S is 1.5 mm.

Figure 13:
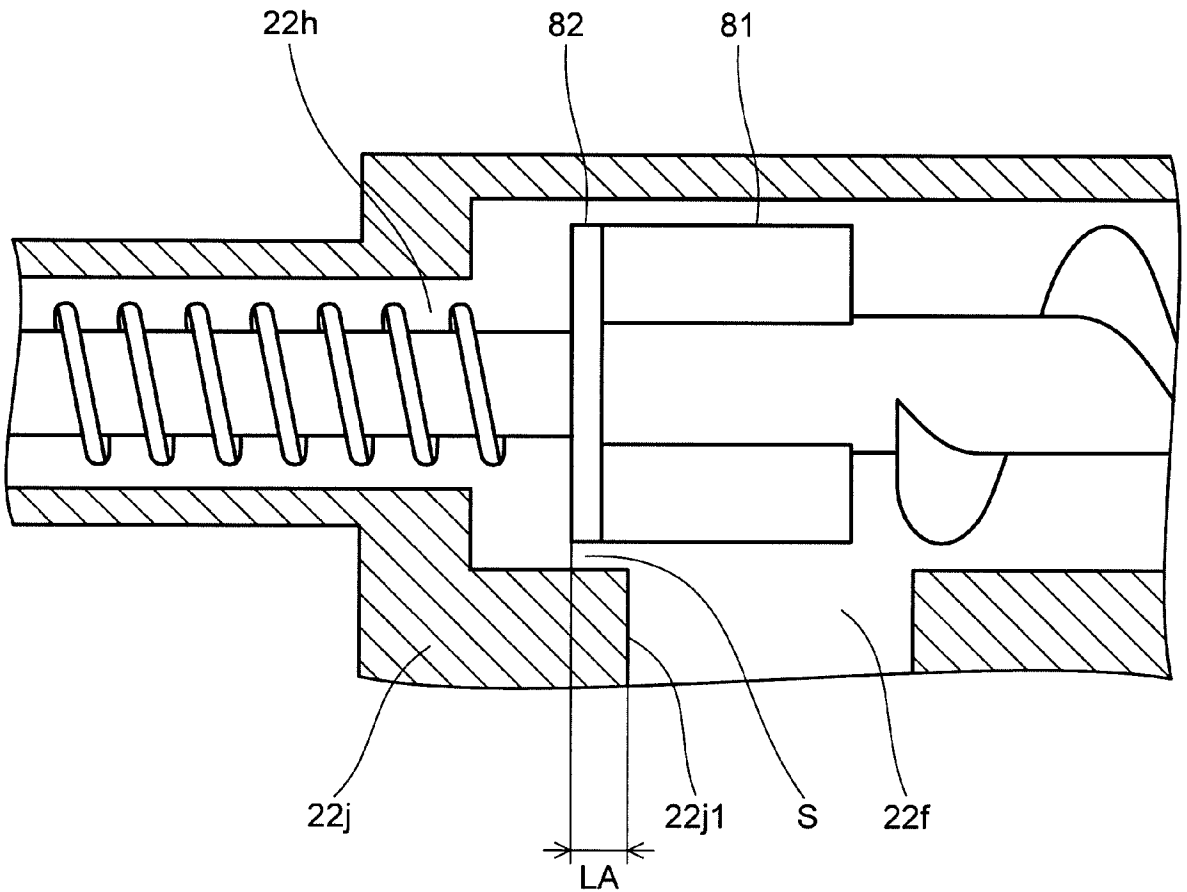
FIG. 13 is a sectional side view of a developer discharge portion of a developing device according to still another comparison example of the present invention.

In the comparison example C, as illustrated in FIG. 13, the end surface 22*j*1 of the downstream side wall portion 22*j* extends to the conveying blade 81, an overlapping amount LA is 3 mm, and the gap S is 1.5 mm.

Figure 14:
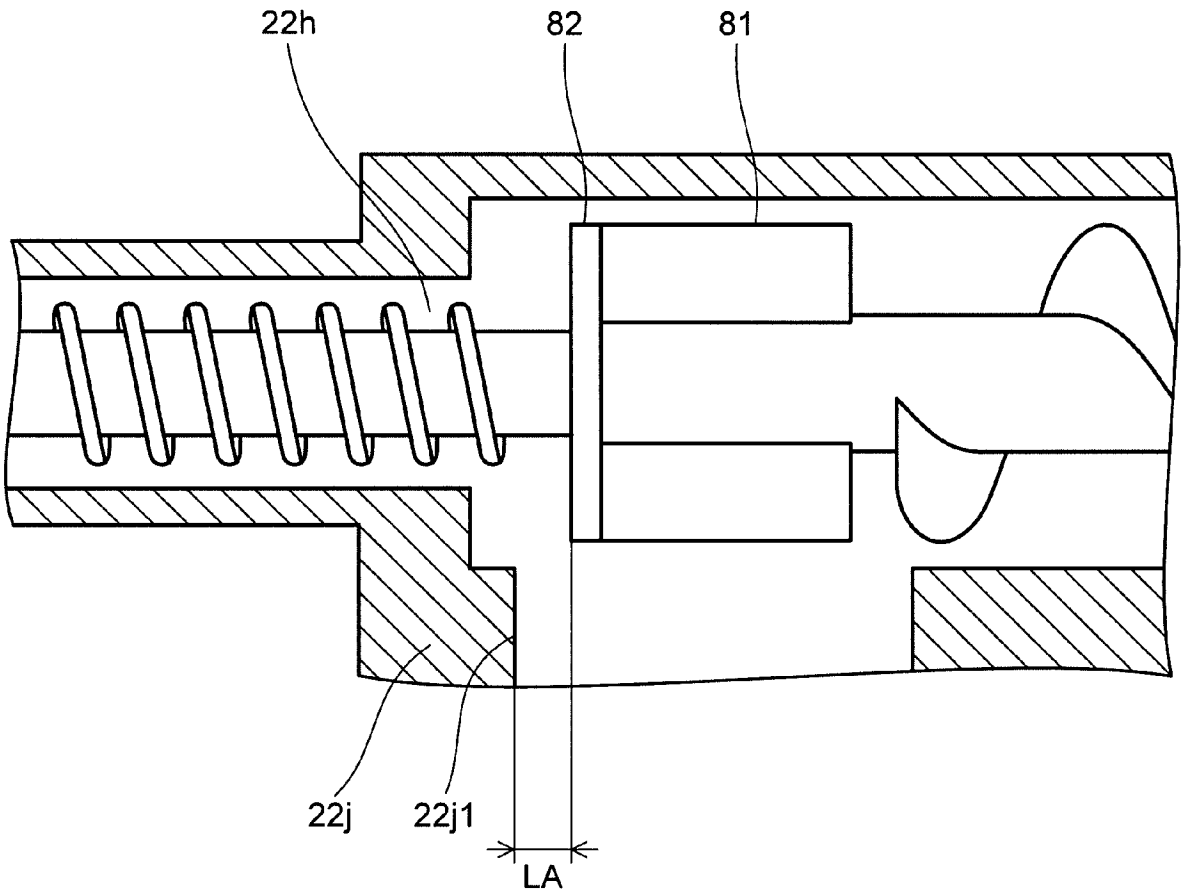
FIG. 14 is a sectional side view of a developer discharge portion of a developing device according to yet another comparison example of the present invention.

In the comparison example D, as illustrated in FIG. 14, the end surface 22*j*1 of the downstream side wall portion 22*j* does not overlap with the plate member 82 in the long side direction, and a separation amount LA with respect to the downstream surface of the plate member 82 is 3 mm.

Figure 15:
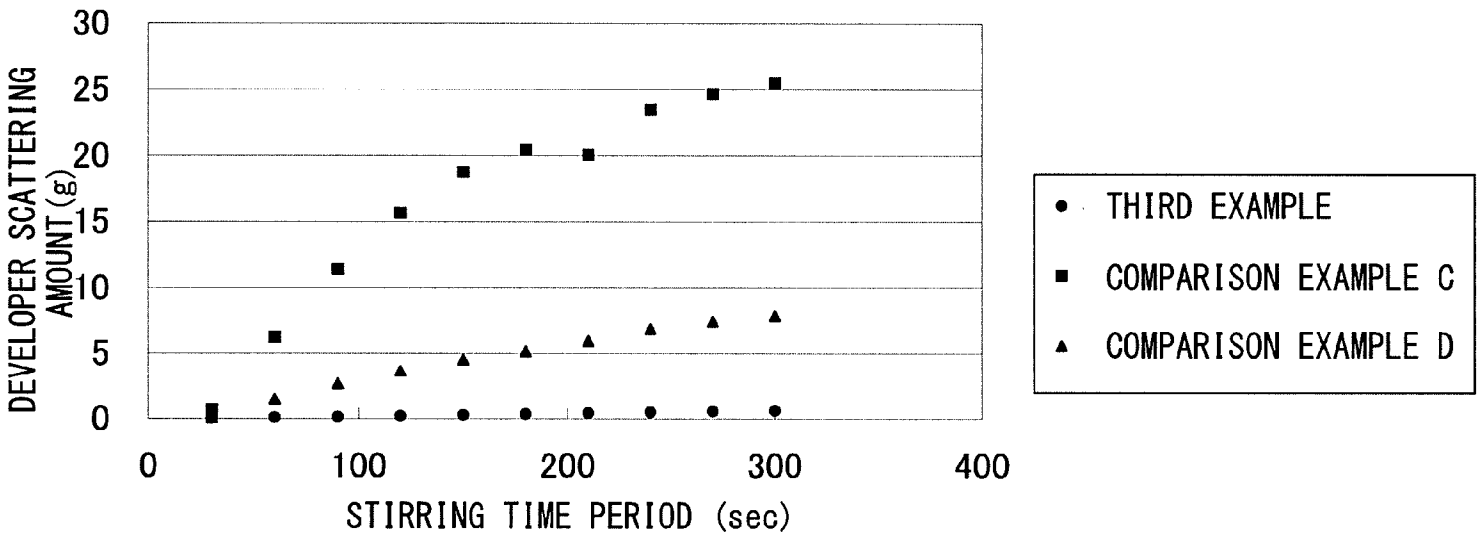
FIG. 15 is a graph showing developer scattering at the developer discharge portions according to a third example and the comparison examples of the present invention.

FIG. 15 shows evaluation results of developer scattering amounts of the third example and the comparison examples C and D. FIG. 15 is a graph in which the abscissa axis represents a stirring time period and the ordinate axis represents the developer scattering amounts.

In the comparison example C (FIG. 13), when the developer on the conveying blade 81 is conveyed to the downstream communication portion 22*f*, even with the rotation of the conveying blade 81, the developer on a plate member 82 side collides against the downstream side wall portion 22*j*, and is stopped. The stopped developer is pushed out to the developer discharge port 22*h* side by the developer conveyed to the downstream side by the rotation of the second helical blade 44*a*. As a result, the developer scattering amount increases in proportion to the stirring time period.

In the comparison example D (FIG. 14), when the developer on the conveying blade 81 is conveyed to the downstream communication portion 22*f*, the developer on the plate member 82 side is pushed to the developer discharge port 22*h* side by the developer conveyed to the downstream side by the rotation of the second helical blade 44*a*, with the result of being conveyed from the space (LA) between the plate member 82 and the downstream communication portion 22*f* to the developer discharge port 22*h*. As a result, the developer scattering amount increases in proportion to the stirring time period. Note that, in the comparison example D, there is no risk that the developer on the plate member 82 side is stopped in the downstream side wall portion 22*j*, and hence the developer scattering amount does not increase in comparison with that of the comparison example C.

In the third example, the developer scattering hardly occurred even the stirring time period was prolonged, which showed satisfactory results.

Fourth Embodiment

Figure 16:
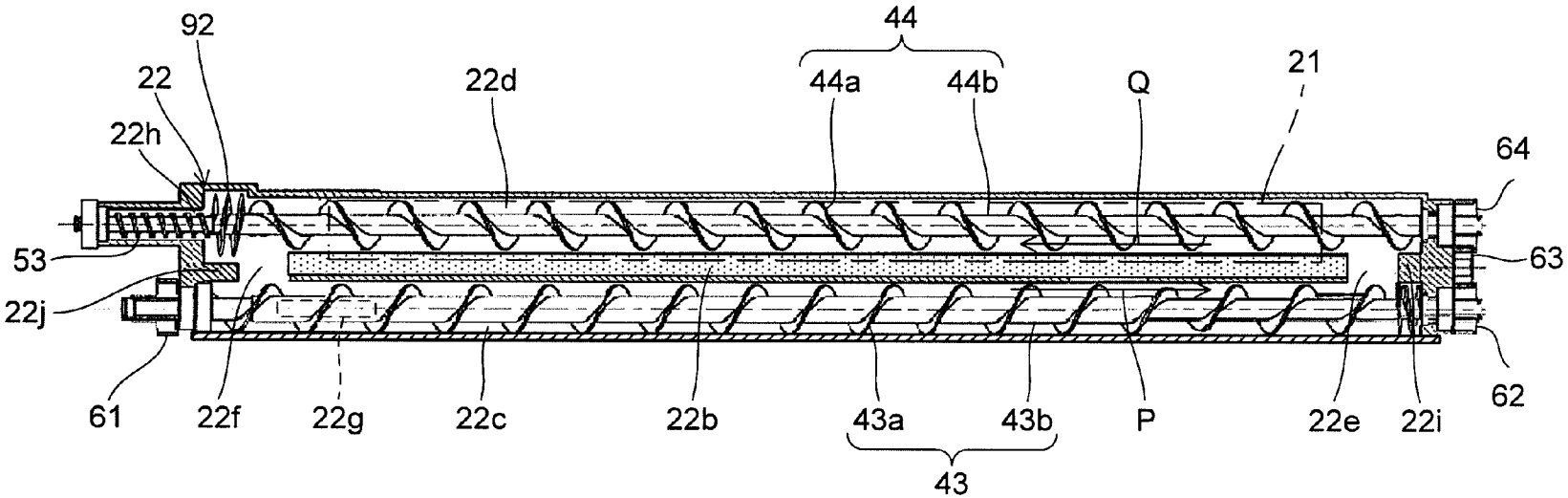
FIG. 16 is a sectional plan view of a stirring portion of a developing device according to a fourth embodiment of the present invention.

FIG. 16 is a sectional side view of a stirring portion of a developing device according to a fourth embodiment. Description is made mainly of a stirring portion provided with a discharge regulating portion different from that in the first embodiment.

The first conveyance path 22*c*, the second conveyance path 22*d*, the partition portion 22*b*, the upstream communication portion 22*e*, the downstream communication portion 22*f*, the developer replenishing port 22*g*, and the developer discharge port 22*h* of the developing container 22 are arranged and configured similarly to those in the first embodiment. Further, the first stirring member 43 including the rotary shaft 43*b* and the first helical blade 43*a* is arranged and configured also similarly to those in the first embodiment. Still further, the second helical blade 44*a*, the discharge blade 53, and a reverse helical blade 92 which constitutes a discharge regulating portion, are arranged integrally with the rotary shaft 44*b* of the second stirring member 44. Although the second helical blade 44*a* and the discharge blade 53 are arranged and configured similarly to those in the first embodiment, the reverse helical blade 92 is configured differently from the discharge regulating portion in the first embodiment.

The reverse helical blade 92 is helically constructed of a (reverse phase) blade directed in the direction reverse to that of the second helical blade 44*a*, and formed to have an outer diameter larger than that of the second helical blade 44*a*. Further, the reverse helical blade 92 is formed to have a blade pitch smaller than that of the second helical blade 44*a* and constructed of a twice-to-thrice wound blade so as not to be long in the axial direction. Further, the reverse helical blade 92 is arranged between the second helical blade 44*a* and the developer discharge port 22*h* at an interval with respect to an inner peripheral surface of the second conveyance path 22*d*, the inner peripheral surface being formed on the downstream side wall portion 22*j*. Accordingly, the discharge regulating portion is allowed to make the surplus developer in the second conveyance path 22*d* climb over an outer peripheral portion of the reverse helical blade 92 and be discharged into the developer discharge port 22*h*.

The rotary shaft 44*b* extends into the developer discharge port 22*h*. The discharge blade 53 is provided on a part of the rotary shaft 44*b*, the part corresponding to an inside of the developer discharge port 22*h*. Although being constructed of the helical blade directed in the same direction as that of the second helical blade 44*a*, the discharge blade 53 has the blade pitch smaller than that of the second helical blade 44*a*, and the outer diameter of the discharge blade 53 is smaller than that of the second helical blade 44*a*. Accordingly, the discharge blade 53 is rotated in accordance with the rotation of the rotary shaft 44*b*, and the surplus developer conveyed into the developer discharge port 22*h* after climbing over the reverse helical blade 92 is sent to the left side of FIG. 16 and discharged outside the developing container 22. Note that, the discharge blade 53, the reverse helical blade 92, and the second helical blade 44*a* are molded of a synthetic resin integrally with the rotary shaft 44*b*.

Figure 17:
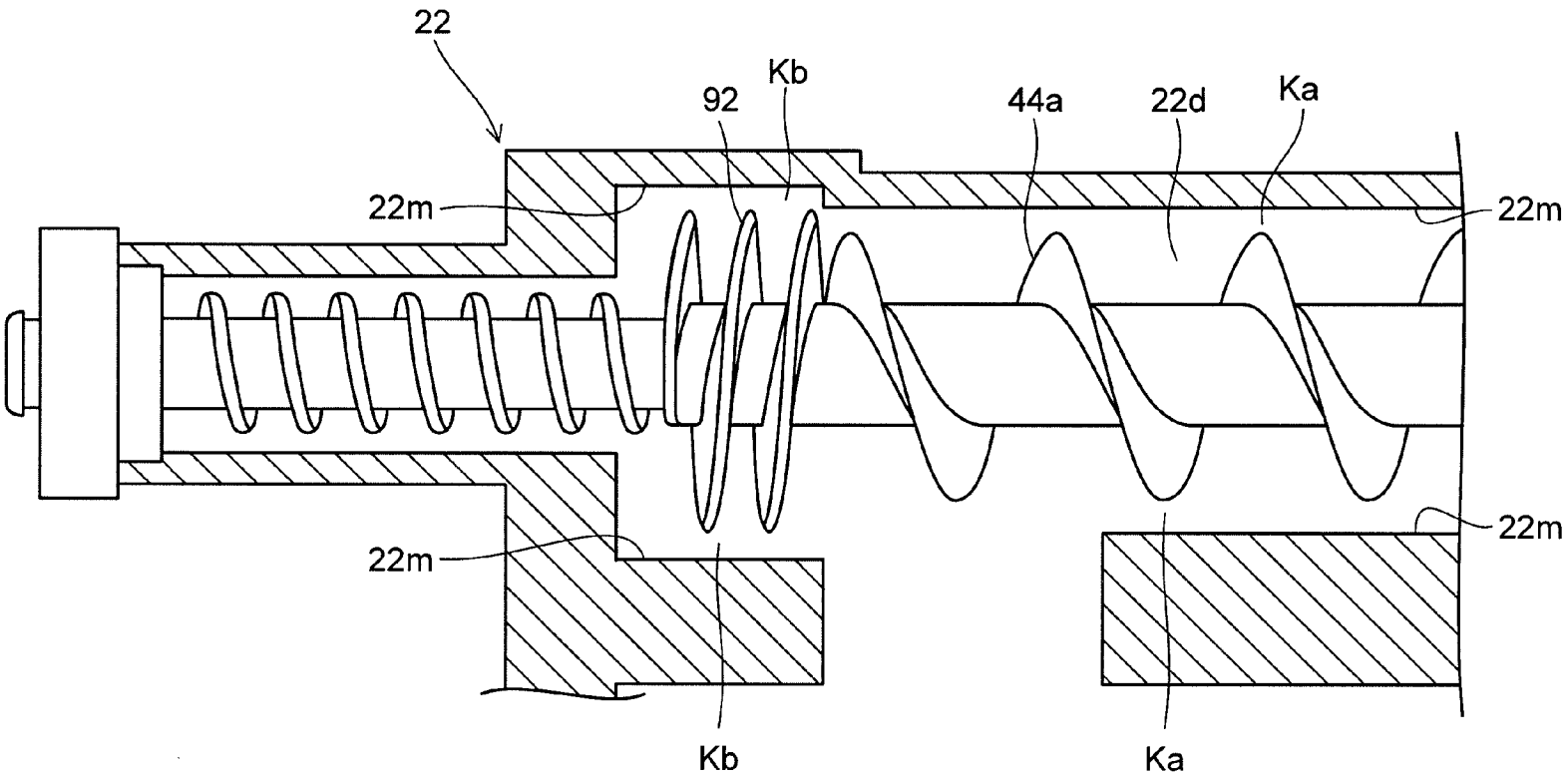
FIG. 17 is a sectional plan view of a developer discharge portion of the developing device according to the fourth embodiment of the present invention.
Figure 18B:
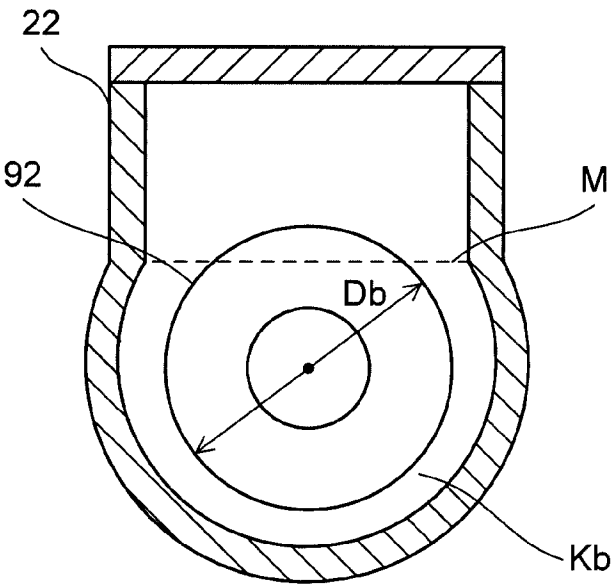
FIG. 18 are schematic sectional views of a helical blade and a reverse helical blade in a developing container of the developing device according to the fourth embodiment of the present invention.
Figure 18A:
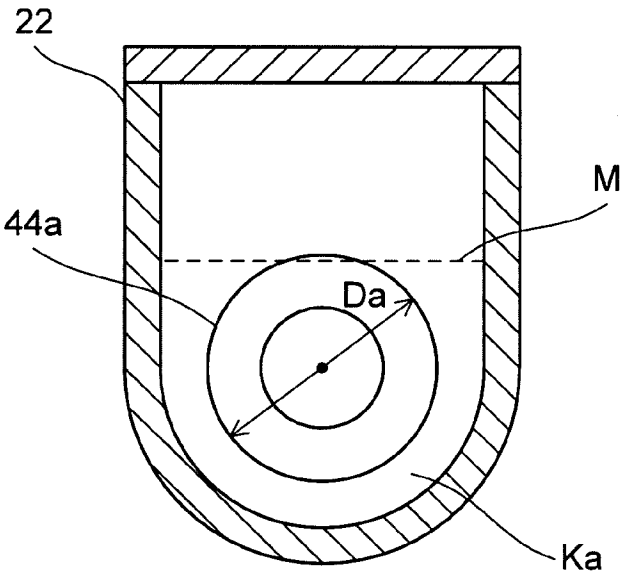

Next, description is made of a detailed structure of the reverse helical blade 92 with reference to FIGS. 17, 18A, and 18B. FIG. 17 is a plan view of the second helical blade 44*a*, the reverse helical blade 92, and a periphery thereof. FIG. 18A is a schematic sectional view of the second helical blade 44*a* in the developing container 22, and FIG. 18B is a schematic sectional view of the reverse helical blade 92 in the developing container 22.

As illustrated in FIG. 17, an interval Ka is formed between the outer peripheral portion of the second helical blade 44*a* and an inner peripheral surface 22*m* of the second conveyance path 22*d*. The interval Ka is constructed of inner peripheral surfaces on a lower side, and left and right sides in the developing container 22 illustrated in FIG. 18A and the outer peripheral portion of the second helical blade 44*a*. Note that, in FIGS. 18A and 18B, a developer surface is represented by reference symbol M.

Further, as illustrated in FIG. 17, the reverse helical blade 92 is provided so as to face the second helical blade 44*a* in the axial direction and to be close to the second helical blade 44*a*. As described above, the reverse helical blade 92 is formed to have the outer diameter larger than that of the second helical blade 44*a*. Further, an interval Kb is formed between the outer peripheral portion of the reverse helical blade 92 and the inner peripheral surface 22*m* of the second conveyance path 22*d*. The interval Kb is constructed of the inner peripheral surfaces on the lower side, and the left and right sides in the developing container 22 illustrated in FIG. 18B and the outer peripheral portion of the reverse helical blade 92. Further, the interval Kb is set to have substantially the same size as that of the interval Ka constructed of the outer peripheral portion of the second helical blade 44*a*.

Through enlargement of the outer diameter of the reverse helical blade 92, a toner conveying capacity of the reverse helical blade 92 is increased. However, the intervals Ka and Kb have substantially the same size, and hence respective toner conveying amounts of the reverse helical blade 92 and the second helical blade 44*a* become substantially the same. As a result, the developer amount in the developing container 22 can be maintained at a desired amount with precision.

Next, when the outer diameter of the second helical blade 44*a* is represented by reference symbol Da as illustrated in FIG. 18A and the outer diameter of the reverse helical blade 92 is represented by reference symbol Db as illustrated in FIG. 18B, it is preferred to satisfy a relation expressed by the following expression.

$$1.1 < Db/Da < 1.3 \quad \text{Expression 1}$$

When a lower limit value of Expression 1 is not reached, the outer diameter of the reverse helical blade 92 approaches the outer diameter of the second helical blade 44*a*. Thus, even when new developer is not replenished, there is a risk that the developer climbs over the outer peripheral portion of the reverse helical blade 92, and hence it is difficult to maintain the developer amount in the developing container 22 to a desired amount. Meanwhile, when an upper limit value of Expression 1 is exceeded, the intervals Ka and Kb are significantly different in size from each other or when the intervals Ka and Kb are set to have the same size, a step is formed on a boundary between the reverse helical blade 92 and the second helical blade 44*a* within a range of the inner peripheral surface 22*m* illustrated in FIG. 17. Thus, the developer is stopped, and hence is difficult to be stably discharged. However, when the outer diameter of the reverse helical blade 92 falls within a numerical range of Expression 1, the developer amount in the developing container 22 can be maintained to a desired amount, and the developing device can be downsized.

According to the fourth embodiment, the developing device 2 includes the developing roller 20 for supplying developer to the photosensitive member 11, and the stirring member 42 which includes the first helical blade 43*a* and the second helical blade 44*a* respectively extending about the rotary shaft 43*b* and the rotary shaft 44*b* in the axial directions thereof and stirs and conveys the developer to be supplied to the developing roller 20. The developing container 22 is provided with the partition portion 22*b* for partitioning the developing container 22 into the first conveyance path 22*c* and the second conveyance path 22*d* in which developer is circulatingly conveyed by the stirring member 42, the upstream communication portion 22*e* and the downstream communication portion 22*f* for communicating the first conveyance path 22*c* and the second conveyance path 22*d* with each other on the both-end-portion sides in the long side direction of the partition portion 22*b*, the developer replenishing port 22*g* from which the developer is supplied, and the developer discharge port 22*h* which is provided on the downstream side of the second conveyance path 22*d* (one conveyance path) and from which surplus developer is discharged. The discharge regulating portion is provided to the second stirring member 44 (stirring member) arranged in the second conveyance path 22*d*. The discharge regulating portion includes the reverse helical blade 92 helically formed in a reverse phase with respect to the second helical blade 44*a*, and the outer diameter Db of the reverse helical blade 92 is larger than the outer diameter Da of the second helical blade 44*a*.

With this structure, developer is supplied from the developer replenishing port 22*g* into the developing container 22, and the developer is conveyed while being stirred by the stirring member 42. Then, the developer thus conveyed moves to the downstream side of the second conveyance path 22*d*. In the downstream side, the developer is retained by the reverse helical blade 92, and surplus developer having exceeded the height of the reverse helical blade 92 overflows from the outer peripheral portion of the reverse helical blade 92 into the developer discharge port 22*h*. Accordingly, the surplus developer can be stably discharged outside the developing container 22 from the developer discharge port 22*h*.

Meanwhile, when new developer is not replenished, the developer conveyed moves to the downstream side of the second conveyance path 22*d* in an undulating manner in conformity with the outer periphery of the second helical blade 44*a*, and collides against the reverse helical blade 92. Further, the outer diameter Db of the reverse helical blade 92 is larger than the outer diameter Da of the second helical blade 44*a*. Thus, when colliding against the reverse helical blade 92, developer having height which moves in an undulating manner does not climb over the outer peripheral portion of the reverse helical blade 92 even when the second helical blade 44*a* is rotated at high speed. Accordingly, the developer amount in the developing container 22 can be accurately maintained to a desired amount, and it is unnecessary to separate the reverse helical blade 92 from the second helical blade 44*a*. As a result, the developing device can be downsized. Further, the developing device 2 according to this embodiment is applicable to high-speed image forming apparatuses.

Next, description is made of a fourth example in which the fourth embodiment is further specified and a comparison example E. Note that, the present invention is not limited only to the following examples.

The developing roller 20 used in each of the fourth example and the comparison example E has an outer diameter of 16 mm and is rotated at 878 rpm, and the magnetic roller 21 has an outer diameter of 20 mm and is rotated at 700 rpm. In the first stirring member 43, the first helical blade 43*a* has an outer diameter of 18 mm, the blade pitch is 30 mm (two-row winding), and further, the rotary shaft 43*b* has a shaft diameter of 7 mm and is rotated at 500 rpm. Meanwhile, the outer diameter Da of the second helical blade 44*a* of the second stirring member 44 is 18 mm, the blade pitch is 30 mm (two-row winding), and further, a shaft diameter of the rotary shaft 44*b* is 7 mm and is reverse-rotated with respect to the first helical blade 43*a* at 500 rpm.

In the fourth example, the reverse helical blade 92 has the outer diameter Db of 20 mm, and 2.5 blades. Meanwhile, in the comparison example E, the reverse helical blade 92 has the outer diameter Db of 18 mm, and 2.5 blades.

Toner in the developing container 22 according to the fourth example and the comparison example E has an average particle diameter of 6.8 μm, carrier has an average particle diameter of 35 μm, and weight percentage of the toner with respect to the carrier is 9%. In new developer replenished into the developing container 22, weight percentage of carrier with respect to toner is 10%. Four hundred grams of the developer are stored in the developing container 22 (first conveyance path 22*c* and second conveyance path 22*d*), the amount of 400 g being a predetermined amount excluding surplus developer from the developing container 22.

In the developing device according to the fourth example and the comparison example E structured as described above, evaluation of a developer scattering amount at the discharge portion is made. Note that, the developer scattering amount is an amount of developer conveyed from inside the first conveyance path 22*c* and the second conveyance path 22*d* into the developer discharge port 22*h*.

Figure 19:
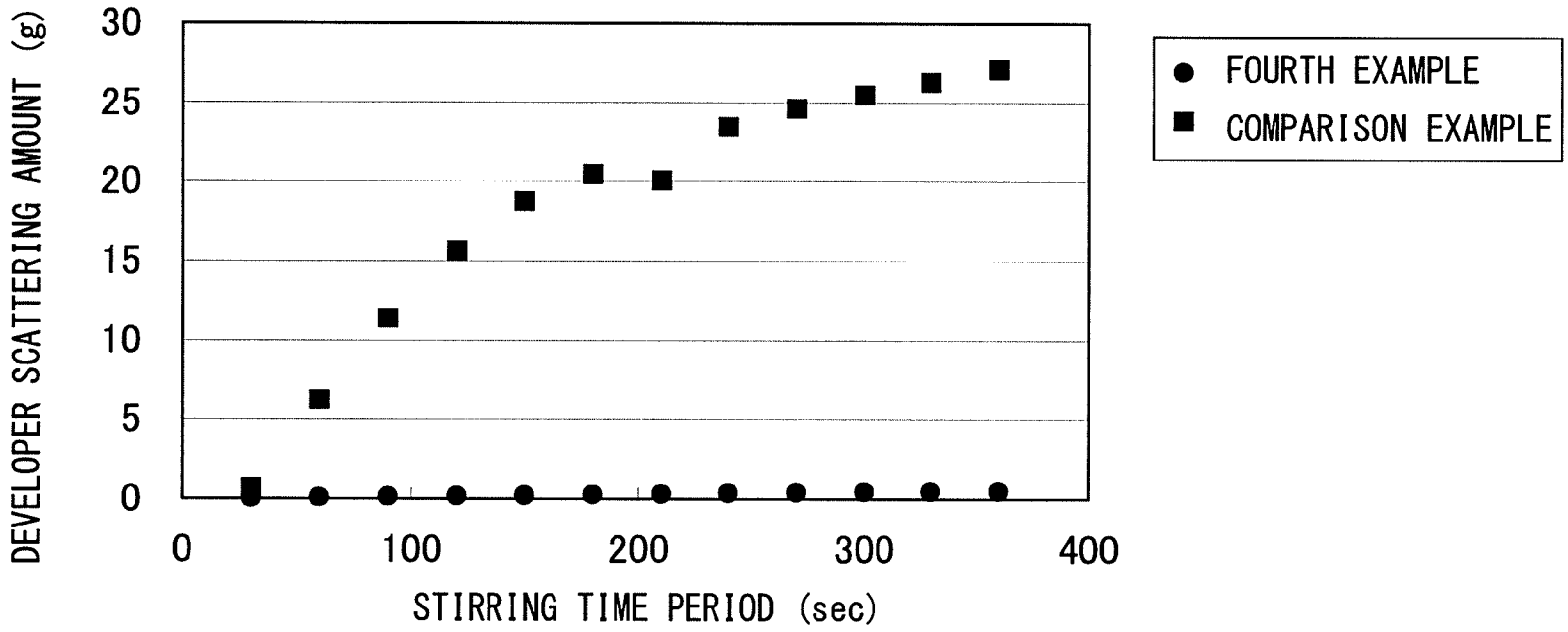
FIG. 19 is a graph showing developer scattering at developer discharge portions according to a fourth example and yet another comparison example of the present invention.

FIG. 19 shows evaluation results of developer scattering amounts of the fourth example and the comparison example E. FIG. 19 is a graph in each of which the abscissa axis represents a stirring time period and the ordinate axis represents the developer scattering amounts.

In the comparison example E, the developer scattering amount increases in proportion to the prolongation of the stirring time period. Meanwhile, in the fourth example, the developer scattering hardly occurred even the stirring time period was prolonged, which showed satisfactory results.

Note that, in the first to fourth embodiments, a case is exemplified, where the present invention is applied to the developing device which includes the developing roller 20 and the magnetic roller 21, and in which the magnetic brush is held on the magnetic roller 21, only toner is supplied to the developing roller 20, and the toner on the developing roller 20 is caused to fly to the photosensitive member 11. However, the present invention is not limited thereto, and may be applied to a developing device in which developer is scooped up from a stirring member to a developing roller, and only toner is supplied out of developer on a developing roller incorporating magnets to a photosensitive member.

Further, in the first to fourth embodiments, a structure is described, in which the first stirring member 43 is arranged in the first conveyance path 22*c* and the second stirring member 44 is arranged in the second conveyance path 22*d*. However, the present invention is not limited thereto, and may employ a structure in which a third conveyance path is further provided, and a third stirring member is arranged in the third conveyance path. Also in this case, the same advantages as those in the above-mentioned embodiments can be obtained.

Still further, in the first and second embodiments, a case is exemplified, where the decelerating conveyance member 51 (or 71) is constructed of the helical blade having the blade pitch smaller than that of the second helical blade 44*a* of the second stirring member 44, or by the helical blade having the outer diameter smaller than that of the second helical blade 44*a*. However, the present invention is not limited thereto, and may employ a structure in which a plurality of holes are provided to the blades of the decelerating conveyance member 51 (or 71) so that the conveying speed of the developer is reduced. Also in this case, the same advantages as those in the above-mentioned embodiments can be obtained.

Yet further, in the first and second embodiments, a structure is described, in which the regulating member 52 is constructed of the helical blade formed in the reverse phase with respect to the second helical blade 44*a*. However, the present invention is not limited thereto. The regulating member 52 may be constructed of a disk plate larger than an opening of the developer discharge port 22*h*, provided to the rotary shaft 44*b*, and arranged adjacently to the decelerating conveyance member 51 (or 71) near the developer discharge port 22*h*.

The present invention can be used for a developing device used in an image forming apparatus such as an electrophotographic copier, a printer, a facsimile, and a composite apparatus having functions of those devices, and for an image forming apparatus provided with the developing device. In particular, the present invention can be used for a developing device which replenishes a two-component developer constructed of toner and carrier and discharges surplus developer and for an image forming apparatus provided with the developing device.

What is claimed is:

1. A developing device, comprising:

a developing roller for supplying developer to an image carrier;

a plurality of stirring members each including a helical blade helically extending about a rotary shaft in an axial direction of the rotary shaft, for stirring and conveying the developer supplied to the developing roller;

a developing container having:

a partition portion for partitioning the developing container into conveyance paths in which the developer is circulatingly conveyed by the plurality of stirring members;

communication portions for communicating the conveyance paths with each other on both-end-portion sides in a long side direction of the partition portion;

a developer replenishing port from which the developer is replenished; and a developer discharge port which is provided on a downstream side of one of the conveyance paths and from which surplus developer is discharged; and a discharge regulating portion provided to one of the plurality of stirring members which is arranged in the one of the conveyance paths, wherein the discharge regulating portion comprises a reverse helical blade helically formed in a reverse phase with respect to the helical blade of the one of the plurality of stirring members, the reverse helical blade being formed to have an outer diameter larger than an outer diameter of the helical blade of the one of the plurality of stirring members, and an interval between an outer peripheral portion of the reverse helical blade and an inner peripheral surface of the one of the conveyance paths is substantially the same as an interval between an outer peripheral portion of the helical blade of the one of the plurality of stirring members and the inner peripheral surface of the one of the conveyance paths.

2. A developing device according to claim 1, wherein an expression $1<Db/Da<1.3$ is satisfied where the outer diameter of the helical blade of the one of the plurality of stirring members is represented by Da and the outer diameter of the reverse helical blade is represented by Db.

3. An image forming apparatus, comprising the developing device according to claim 1.

* * * * *